US007832065B2

(12) United States Patent
Meager

(10) Patent No.: US 7,832,065 B2
(45) Date of Patent: Nov. 16, 2010

(54) DEVICE FOR CREATING A SEAL BETWEEN FABRICS OR OTHER MATERIALS

(75) Inventor: Ben Meager, Bozeman, MT (US)

(73) Assignee: Gore Enterprise Holdings, Inc., Newark, DE (US)

( * ) Notice: Subject to any disclaimer, the term of this patent is extended or adjusted under 35 U.S.C. 154(b) by 626 days.

(21) Appl. No.: 11/769,615

(22) Filed: Jun. 27, 2007

(65) Prior Publication Data

US 2008/0022496 A1 Jan. 31, 2008

Related U.S. Application Data

(60) Provisional application No. 60/806,021, filed on Jun. 28, 2006.

(51) Int. Cl.
*A44B 19/32* (2006.01)

(52) U.S. Cl. ..... 24/399; 24/400; 24/415; 24/428

(58) Field of Classification Search ..... 24/399, 24/400, 415, 416, 417, 426, 428; 383/61.3, 383/64

See application file for complete search history.

(56) References Cited

U.S. PATENT DOCUMENTS

| | | | |
|---|---|---|---|
| 1,703,712 | A | 2/1929 | Aud |
| 1,706,097 | A | 3/1929 | Aud |
| 1,719,856 | A | 7/1929 | Sipe |
| 1,887,741 | A | 11/1932 | Trotter |
| 1,959,318 | A | 5/1934 | Sundback |
| 1,959,319 | A | 5/1934 | Sipe |
| 2,217,571 | A | 10/1940 | Susskind |
| 2,263,481 | A | 11/1941 | Austin |
| 2,353,858 | A | 7/1944 | Tedesco |
| 2,355,816 | A | 8/1944 | Morner |
| 2,491,524 | A | 12/1949 | Siple |
| 2,506,965 | A | 5/1950 | Morin |
| 2,507,445 | A | 5/1950 | Krueger |
| 2,613,421 | A | 10/1952 | Madsen |
| 2,652,611 | A | 9/1953 | Jaster |
| 2,665,467 | A | 1/1954 | Bosomworth et al. |
| 2,696,032 | A | 12/1954 | Sander |
| 2,777,181 | A | 1/1957 | Morner |
| 2,794,227 | A | 6/1957 | Dorman |
| 2,797,463 | A | 7/1957 | Dorman et al. |

(Continued)

FOREIGN PATENT DOCUMENTS

| | | |
|---|---|---|
| BE | 514 547 | 10/1952 |

(Continued)

OTHER PUBLICATIONS

International Preliminary Examination Report for PCT Application No. PCT/US02/13558, mailed on Jan. 26, 2007.

(Continued)

*Primary Examiner*—Robert J Sandy
(74) *Attorney, Agent, or Firm*—James Arnold, Jr.

(57) ABSTRACT

A fastening system is provided that interconnects and disengages two fastening members. Further, a method of sealing the two fastening members is provided wherein a device that is adapted to separate adjoined fastening members is also used to create an obstruction between the fastening members to prevent the free flow of liquid and/or gas.

34 Claims, 37 Drawing Sheets

U.S. PATENT DOCUMENTS

| | | | |
|---|---|---|---|
| 2,810,944 | A | 10/1957 | Sander |
| 2,869,207 | A | 1/1959 | Berstein |
| 2,871,539 | A | 2/1959 | Swan |
| 2,889,605 | A | 6/1959 | Morin |
| 2,909,822 | A | 10/1959 | Botti et al. |
| 2,941,027 | A | 6/1960 | Svec |
| 2,978,769 | A | 4/1961 | Harrah |
| 3,153,269 | A | 10/1964 | Berry |
| 3,203,062 | A | 8/1965 | Ausnit |
| 3,259,951 | A | 7/1966 | Zimmerman |
| 3,266,112 | A | 8/1966 | Heckman |
| 3,309,746 | A | 3/1967 | Carlile |
| 3,325,084 | A | 6/1967 | Ausnit |
| 3,338,285 | A | 8/1967 | Jaster |
| 3,426,396 | A | 2/1969 | Laguerre |
| 3,490,109 | A | 1/1970 | Heimberger |
| 3,579,747 | A | 5/1971 | Hawley |
| 3,591,914 | A | 7/1971 | Heimberger |
| 3,660,875 | A | 5/1972 | Gutman |
| 3,914,827 | A | 10/1975 | Brown et al. |
| 3,959,856 | A | 6/1976 | Ausnit |
| 4,070,515 | A | 1/1978 | Smarook |
| 4,112,150 | A | 9/1978 | Brown et al. |
| 4,137,608 | A | 2/1979 | Moertel |
| 4,199,845 | A | 4/1980 | Ausnit |
| 4,262,395 | A | 4/1981 | Kosky |
| 4,756,061 | A | 7/1988 | Jones et al. |
| 4,890,935 | A | 1/1990 | Ausnit et al. |
| 4,905,694 | A | 3/1990 | Will |
| 4,929,487 | A | 5/1990 | Tilman et al. |
| 4,941,238 | A | 7/1990 | Clark |
| 5,007,142 | A | 4/1991 | Herrington |
| 5,007,143 | A | 4/1991 | Herrington |
| 5,007,145 | A | 4/1991 | Kim |
| 5,010,627 | A | 4/1991 | Herrington et al. |
| 5,062,186 | A | 11/1991 | Rampolla et al. |
| 5,067,208 | A | 11/1991 | Herrington, Jr. et al. |
| 5,070,583 | A | 12/1991 | Herrington |
| 5,119,530 | A | 6/1992 | Murabayashi et al. |
| 5,152,613 | A | 10/1992 | Herrington, Jr. |
| 5,161,286 | A | 11/1992 | Herrington, Jr. et al. |
| 5,253,395 | A | 10/1993 | Yano |
| 5,283,932 | A | 2/1994 | Richardson et al. |
| 5,397,182 | A | 3/1995 | Gaible et al. |
| 5,415,904 | A | 5/1995 | Takubo et al. |
| 5,438,744 | A | 8/1995 | Horikawa et al. |
| 5,553,339 | A | 9/1996 | Thomas |
| 5,599,415 | A | 2/1997 | Tomic et al. |
| 5,636,415 | A | 6/1997 | James |
| 5,664,299 | A | 9/1997 | Porchia et al. |
| 5,722,128 | A | 3/1998 | Toney et al. |
| 5,809,621 | A | 9/1998 | McCree et al. |
| 5,867,875 | A | 2/1999 | Beck et al. |
| 5,919,535 | A | 7/1999 | Dobreski et al. |
| 5,991,980 | A | 11/1999 | Meager |
| 6,033,113 | A | 3/2000 | Anderson |
| 6,059,457 | A | 5/2000 | Sprehe et al. |
| 6,185,796 | B1 | 2/2001 | Ausnit |
| 6,305,844 | B1 | 10/2001 | Bois |
| 6,363,531 | B1 | 4/2002 | Quinn |
| 6,385,818 | B1 | 5/2002 | Savicki, Sr. |
| 6,394,299 | B1 | 5/2002 | Hupp |
| 6,438,757 | B1 | 8/2002 | Quinn |
| 6,499,878 | B1 | 12/2002 | Dobreski et al. |
| 6,510,595 | B2 | 1/2003 | Matsushima et al. |
| 6,558,037 | B2 | 5/2003 | Gonella |
| 6,592,800 | B1 | 7/2003 | Levitt |
| 6,721,999 | B2 | 4/2004 | Meager |
| 7,062,786 | B2 | 6/2006 | Stinton |
| 2002/0015539 | A1 | 2/2002 | Gonella |
| 2002/0184740 | A1 | 12/2002 | Meager |
| 2004/0049896 | A1 | 3/2004 | Savicki |
| 2004/0187273 | A1 | 9/2004 | Meager |
| 2005/0050699 | A1 | 3/2005 | Yoneoka |
| 2005/0125968 | A1 | 6/2005 | Yamazaki |
| 2005/0157957 | A1 | 7/2005 | Turvey et al. |
| 2006/0037180 | A1 | 2/2006 | Meager |
| 2006/0107500 | A1 | 5/2006 | Meager |

FOREIGN PATENT DOCUMENTS

| | | |
|---|---|---|
| CH | 287845 | 12/1952 |
| EP | 0279599 | 8/1988 |
| EP | 676330 | 10/1995 |
| FR | 1043998 | 11/1953 |
| FR | 2507446 | 12/1982 |
| GB | 899 875 | 6/1992 |
| GB | 2266660 | 11/1993 |
| GB | 2267933 | 12/1993 |
| WO | WO 99/09854 | 3/1999 |
| WO | WO 02/087379 | 11/2002 |
| WO | 03/074371 | 9/2003 |

OTHER PUBLICATIONS

International Preliminary Report on Patentability for International (PCT) Patent Application No. PCT/US05/38691, mailed Issued May 1, 2007.

International Search Report for International (PCT) Patent Application No. PCT/US05/38691, mailed Aug. 14, 2006.

Notification of Transmittal of the International Search Report or the Declaration dated Aug. 5, 2002 for International Patent Application No. PCT/US02/13558.

Notification of Transmittal of the International Search Report or the Declaration dated Dec. 16, 1998 for International Patent Application No. PCT/US98/17599.

Supplementary European Search Report dated Nov. 30, 2000 for European Patent Application No. 98944523.

Written Opinion for International (PCT) Patent Application No. PCT/US05/38691, mailed Aug. 14, 2006.

Fig. 49
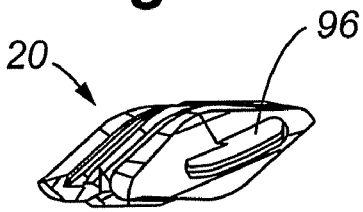
Fig. 50
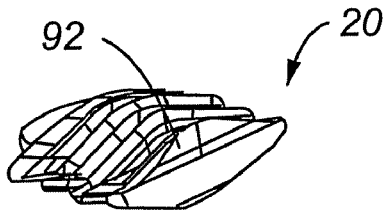
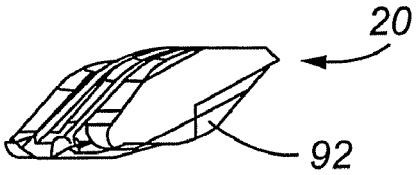
Fig. 51
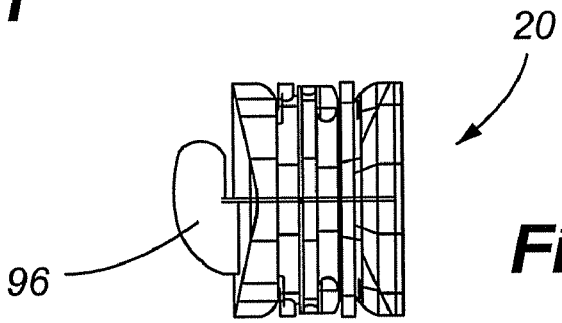
Fig. 52
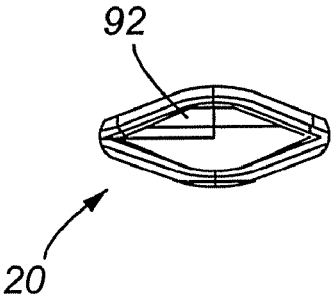
Fig. 53
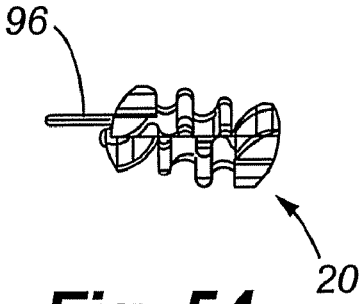
Fig. 54
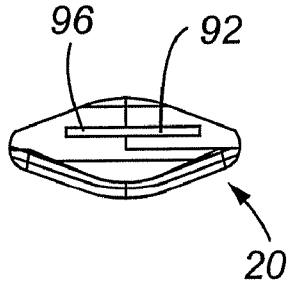
Fig. 55

DEVICE FOR CREATING A SEAL BETWEEN FABRICS OR OTHER MATERIALS

CROSS-REFERENCE TO RELATED APPLICATIONS

This application claims the benefit of U.S. Provisional Patent Application Ser. No. 60/806,021, filed Jun. 28, 2006, which is incorporated herein by reference in its entirety. This application also cross-references but does not claim priority to U.S. Pat. No. 5,991,980 that issued on Nov. 30, 1999, and U.S. Pat. No. 6,721,999 that issued on Apr. 20, 2004. In addition, the present application cross-references but does not claim priority to U.S. patent application Ser. No. 10/803,834 filed on Mar. 17, 2004, U.S. patent application Ser. No. 11/258,655 filed on Oct. 25, 2005, and U.S. patent application Ser. No. 11/259,701 also filed on Oct. 25, 2005. The contents of the above-referenced patents and patent applications are incorporated herein by reference in their entirety.

FIELD OF THE INVENTION

Embodiments of the present invention relate generally to apparatus and methods of fastening and/or sealingly interconnecting at least two items.

BACKGROUND OF THE INVENTION

Fastening devices typically include two flexible elongated components that interlock using a tongue and groove system wherein longitudinally spaced rails interlock and separate by moving a slider. Although such fastening devices have long been used to close and open various articles, such as clothing, containers, bags, drysuits, space suits, drybags, chem/bio shelter systems, bivy sacks, etc., they often allow liquid and/or gas penetration and are therefore not useful for conditions where a gas-tight and/or liquid tight seal is desired. That is, even though some "waterproof" fastening systems are available, they are typically not completely liquid-tight, wherein some amount of liquid and/or gas may penetrate the seal provided. Still other fastening systems are difficult to operate, expensive, heavy, and/or require the use of a covering material over the fastener of the fastening system to establish a liquid-tight and/or gas tight closure.

Thus, a novel fastening mechanism is provided that employs a device to facilitate opening and closing of the item being closed, fastened, or sealed while substantially preventing liquid and/or gas from entering or exiting the seal. The following disclosure describes an improved fastening system that is adapted for interconnection to a bag, a jacket, a pair of waders, a space suit, a container, etc., that includes a slider or sealing device to facilitate fastening, closing, sealing and/or reopening.

SUMMARY OF THE INVENTION

It is to be understood that the present invention includes a variety of different versions or embodiments, and this Summary is not meant to be limiting or all-inclusive. This Summary provides some general descriptions of some, but not necessarily all of the embodiments, and may also include some more specific descriptions of certain embodiments.

It is one aspect of the present invention to provide a fastening system for interconnecting two pieces of fabric, for example. "Fastening system", as used in conjunction with some embodiments described herein, refers to a device that joins at least two elements. It is one aspect of this invention that the fastening system is able to form a liquid-tight, waterproof and/or gas-tight seals. Fastening systems as contemplated herein can be employed in various applications such as interlocking groove and ridge type food bags, military applications (such as body bags and sleeping bags), aerospace applications (such as clean room seals, space suits), underwater applications, or any other application wherein the sealing of an environment is required. Generally, one embodiment of the present invention includes two fastening members that have rail fasteners that interlock via a tongue and groove means that is comprised of a plurality of longitudinally spaced interlocking tongue and grooves, e.g. rails. As used herein, "tongue and groove" or "rails" are meant to include for example, a fastening configuration, closure, or seal made by at least one tongue on one mating surface of a member interlocking with at least one groove on the mating surface of corresponding member, it is understood that fastening profiles other than traditional tongue and groove shapes would also be within the scope of this invention. In operation, the rails are placed adjacent to each other and forced together, thereby maintaining the two fastening members in an engaged, closed, locked, or sealed, relationship. In order to facilitate this engaged arrangement, a device is employed that continuously engages the two rail fasteners as it is moved along the rail fasteners. To disengage the rail fasteners, the device is transitioned to a second position of use and moved along the rail fastener, thereby separating the fastening members.

Accordingly, it is one aspect of the present invention to provide a translatable mechanism or sealing device that includes an intermediate member that separates interlocked rail fasteners, that fills a gap between the fastening members, and that prevents or substantially prevents the ingress and egress of liquid, gas, air or flowable material into or out of the item being sealed. The sealing device of one embodiment includes at least one movable control arm that cooperates with a stationary control arm that forces the rails of the individual fastening members together to close the bag, for example. In order to open the seal, the sealing device is transitioned to a second position of use wherein adjacent control arms do not cooperate, thus allowing the intermediate member of the sealing device to separate the fastening members. Upon review of the detailed description below, one skilled in the art will appreciate that there are many types of intermediate members that may be used to accomplish this task.

It is another aspect of the present invention to provides a fastening system, comprising:

a first closure member including a first mating surface;

a second closure member including a second mating surface, wherein the second mating surface is adapted for positioning substantially opposite the first mating surface for operatively engaging the first mating surface;

an intermediate member having a sloping profile; and a plurality of closure arms interconnected to the intermediate member, the closure arms including an inner surface for pressing against an exterior surface of one of the first and second mating surfaces, wherein at least two of the closure arms confine the first and second mating surfaces in an interlocking and sealed configuration.

It is yet another aspect of the invention to provide a fastening system, comprising:

first and second closure members, wherein the first closure member comprises a first mating surface for engaging a second mating surface of the second closure member, the first and second mating surfaces extending the length of the first and second closure members; and an intermediate member operable to slide between at least a part of the first and second mating surfaces, wherein the intermediate member and the first and second mating surfaces form a closed seal.

It is yet another aspect of the invention to provide a fastening system, comprising:

a first closure member including a first mating surface;

a second closure member including a second mating surface, wherein the second mating surface is adapted for being positioned substantially opposite the first mating surface for operatively engaging the first mating surface;

an intermediate member having a substantially diamond-shaped profile, the intermediate member including a first surface for sealingly engaging the first mating surface and a second surface for sealingly engaging the second mating surface; and wherein the intermediate member forms a closed seal with the first and second mating surfaces of the first and second closure members.

It is yet another aspect of the invention to provide a fastening system, comprising:

first and second means for forming a seal;

a means for operatively engaging the first and second means for forming a seal, the means for operatively engaging including at least a first surface having a means for sealing with the first means for forming a seal, and at least a second surface having a means for sealing with the second means for forming seal;

wherein the first and second means for forming a seal sealably engage the means for operatively engaging when the means for operatively engaging is moved along a longitudinal length of the first and second means for forming a seal.

It is still yet another aspect of the invention to provide a fastening system adapted for use with an article, the article including at least two adjacent portions, the closure device comprising:

first and second means for forming a seal to interconnect the two adjacent portions of the article;

a means for operatively engaging the first and second means for forming a seal, the means for operatively engaging including at least a first surface having a means for sealing with the first means for forming a seal, and at least a second surface having a means for sealing with the second means for forming seal;

wherein the first and second means for forming a seal sealably engage the means for operatively engaging when the means for operatively engaging is moved along a longitudinal length of the first and second means for forming the seal, wherein the seal brings together the two adjacent portions of the article.

It is yet another aspect of the invention to provide a slider for use with a first mating surface and an opposable second mating surface, the first and second mating surfaces having a longitudinal length L, the slider comprising:

a slider core including a first surface for sealingly engaging the first mating surface and a second surface for sealingly engaging the second mating surface, the first and second mating surfaces separated along a length of the slider core; and wherein the slider core sealingly engages the first and second mating surfaces at a plurality of locations along the longitudinal length L of the first and second mating surfaces.

The Summary of the Invention is neither intended nor should it be construed as being representative of the full extent and scope of the present invention. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 49 is a front perspective view of an intermediate member of another embodiment of the present invention with a selectively movable portion;

FIG. 50 is a rear perspective view of the intermediate member shown in FIG. 49;

FIG. 51 is a bottom perspective view of the intermediate member shown in FIG. 49;

FIG. 52 is top plan view of FIG. 49;

FIG. 53 is a right elevation view of FIG. 49;

FIG. 54 is a front elevation view of FIG. 49;

FIG. 55 is a left elevation view of FIG. 49;

Figure 1:
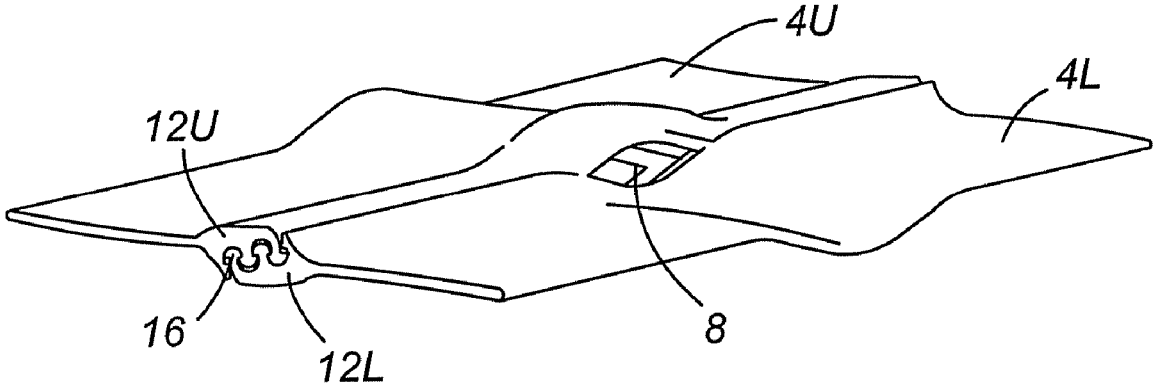
FIG. 1 is a perspective view of two interconnected fastening members.
Figure 5:
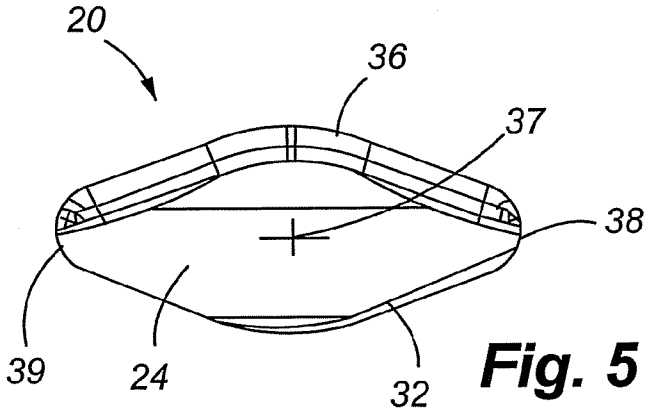
FIG. 5 is a left elevation view of the intermediate member shown in FIG. 2.
Figure 3:
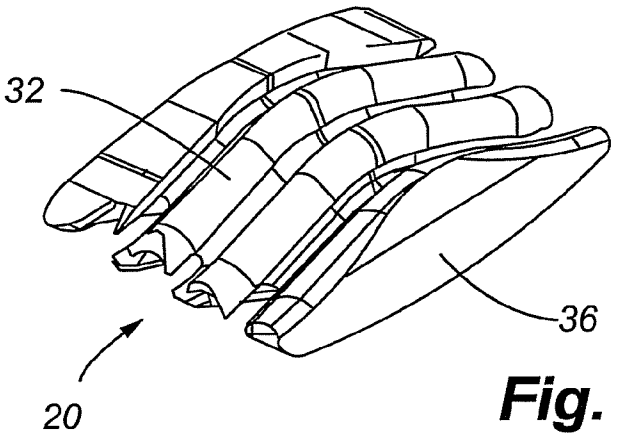
FIG. 3 is a bottom perspective view the intermediate member shown in FIG. 2.
Figure 4:
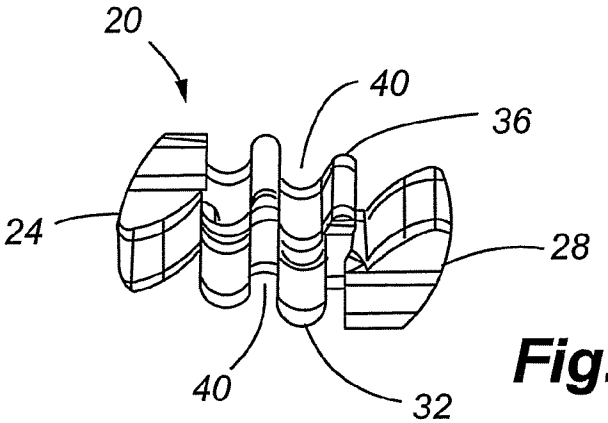
FIG. 4 is a front elevation view of the intermediate member shown in FIG. 2.
Figure 2:
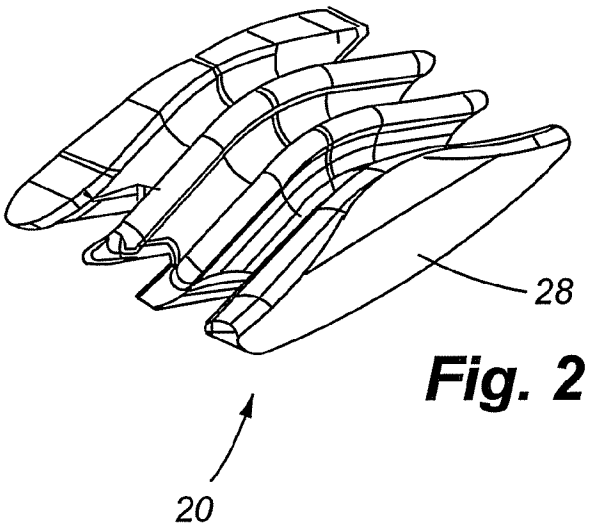
FIG. 2 is a top perspective view of an intermediate member of one embodiment of the invention.
Figure 6:
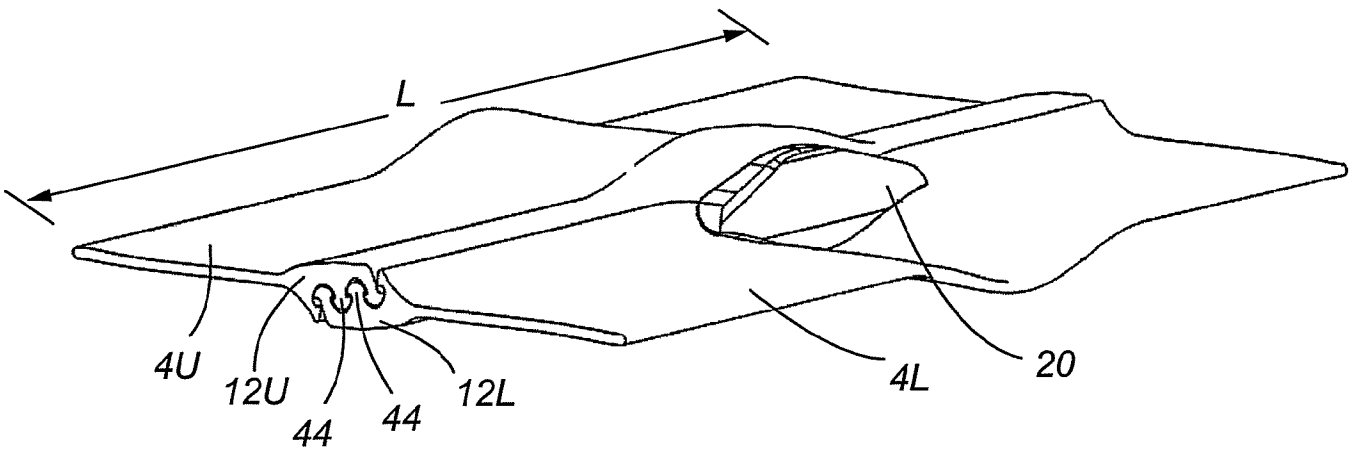
FIG. 6 is a perspective view, similar to FIG. 1, wherein the intermediate member of one embodiment of the present invention is positioned in a gap between two interconnected fastening members.
Figure 8:
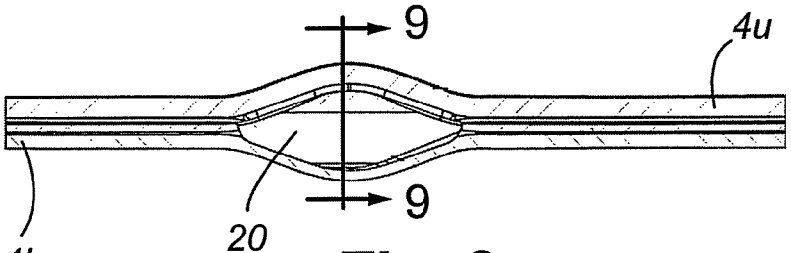
FIG. 8 is a right elevation view of FIG. 6.
Figure 7:
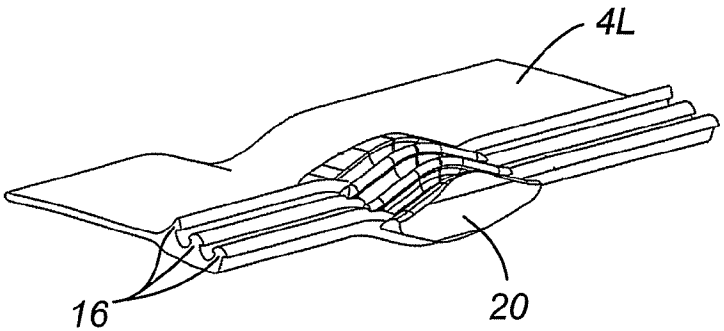
FIG. 7 is a perspective view similar to FIG. 6 wherein an upper fastening member has been removed for clarity.

To assist in the understanding of the present invention the following list of components and associated numbering found in the drawings is provided herein:

| No. | Components |
|---|---|
| 2 | Sealing device |
| 4U | Upper fastening member |
| 4L | Lower fastening member |
| 8 | Gap |
| 12U | Upper rail fastener |
| 12L | Lower rail fastener |
| 16 | Rails |
| 20 | Intermediate member |
| 24 | Left surface |
| 28 | Right surface |
| 32 | Lower contour |
| 36 | Upper contour |
| 37 | Midpoint |
| 38 | First leader end |
| 39 | Second leader end |
| 40 | Groove |
| 44 | Rail |
| 48 | Movable control arm |
| 52 | Stationary control arm |
| 56 | Hinge |
| 58 | Hinge fastener |
| 60 | Separation |
| 64 | Pull tab track |
| 68 | Pull tab |
| 72 | Termination point |
| 74 | Seal |
| 80 | Pivot |

-continued

| No. | Components |
|---|---|
| 84 | Aperture |
| 88 | Shaft |
| 92 | Segment |
| 96 | Tab |
| 100 | Top half |
| 104 | Bottom half |
| 108 | Longitudinal hinge |
| 112 | Valve |
| 116 | Button |
| L | Longitudinal length |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Referring now to FIG. 1-19, one embodiment of a slider, hereinafter a "sealing device" 2 is provided that interconnects and releases at least two fastening members 4 that are associated with a piece of clothing, a food container, a body bag, a shopping bag, a test chamber, a pair of waders, a tent, a space suit, a protective biohazard suit, a mask, a sleeping bag, a sample bag, or any other item that is designed to selectively open and close and that when closed, is to be generally air and/or liquid tight. As will be apparent upon review of the following, due to the orientation of the fastening members 4 and the use of the sealing device 2, a gap 8 forms. More specifically, fastening members 4 as contemplated herein, employ a rail fastener 12 having a plurality of tongue and groove structures or rails 16 for interlocking relationship with a corresponding fastening member 4. The gap 8 is detrimental since it results in a seal that is neither liquid or gas tight. Thus one embodiment of the present invention provides an intermediate member 20 between fastening members 4 to substantially prevent liquid and/or gas from penetrating the sealed interface. The intermediate member 20 thus acts as a plug that maintains the integrity of the seal. The intermediate member 20 also provides the mechanism by which the interconnected rail fasteners 12 are separated. In order to seal and reseal the rail fasteners 12, control arms are used that provide the requisite force needed to interlock the rails 16 of corresponding rail fasteners 12.

Referring now specifically to FIG. 1, the fastening members 4 employed by embodiments of the present invention are shown. Often, two pieces of fabric or other material are interconnected by utilizing a pair of fastening members 4, wherein the fastening members 4 are attached (sewn, welded, glued, taped, etc.) onto the fabric or other material and are designed to interlock. However, attachment may be done by any other various known techniques known in the art. The problem with orienting the fastening devices 4 in this manner is that a gap 8 must be included between the fastening members 4 to accommodate a slider mechanism of some type which facilitates opening and closing of the seal. In operation, the two pieces of fabric are interconnected by way of an upper fastening member 4U and a lower fastening member 4L. The upper fastening member 4U includes an upper rail fastener 12U and the lower fastening member 4L includes a lower rail fastener 12L. Each rail fastener 12 is comprised of a plurality of longitudinally oriented rails 16 that interlock to provide a mechanical seal between the upper fastening member 4U and the lower fastening member 4L. To gain access to the sealed bag, for example, the sealing device is slid along the length of the rail fasteners 12, to disconnect and separate the interlocked rails.

Referring now specifically to FIGS. 2-5, the intermediate member 20 is provided that blocks the aforementioned gap 8 and that provides a mechanism for opening and closing the seal. More specifically, the intermediate member 20 is a device that engages the upper rail fastener and the lower rail fastener wherein sliding the intermediate member 20 along the length of the rail fasteners separates the interlocked rails. The intermediate member 20 includes a left surface 24 that is spaced from a right surface 28 that defines a width that spans at least the width of the rail fasteners. In addition, the intermediate member 20 includes an upper contour 36 and a lower contour 32 that are defined by grooves 40 that interface with the rails of the rail fasteners to provide a liquid-tight and/or gas-tight seal. The grooves 40, upper contour 36, and lower contour 32 of the intermediate member 20 are specifically fashioned to coincide with the spaces between individual rails of the rail fasteners. One skilled in the art, however, will appreciate that the upper contour 36 and lower contour 32 do not necessarily have to match the rail fastener rails to provide a tight seal and/or the functionability of separating the rail fasteners. In operation, which will be described in further detail below, the lower contour 32 of the intermediate member 20 is engaged to the lower rail fastener and the upper contour 36 of the intermediate member 20 is interconnected to the upper rail fastener. The rail fasteners fore and aft of the intermediate member are interconnected wherein the corresponding rails of the upper rail fastener and the lower rail fastener interlocked. Thus, by sliding the intermediate member 20 along the edge of the fastening members within the interlocked rails of the rail fasteners, the upper fastening member and lower fastening member are separated, thereby providing access to the items stored within the bag, for example.

As shown in FIGS. 2-5, the intermediate member 20 exhibits the upper contour 36 and a lower contour 32 that defines a thickness. The intermediate member further includes a midpoint 37 located between a first leader end 38 and a second leader end 39 as illustrated. The distance between the upper contour 36 and the lower contour 32 is greater at the midpoint 37 than at either of the leader ends to allow for movement and sealing of the rail fasteners of the fastening members. The intermediate member 20 has a shape profile that forms and maintains a continuous seal with the rail fasteners of the fastening members, at least in its fully closed aspect. The present invention allows various engineering of the system to provide desired sizes, fastening member flexibility, length, and choice of intermediate member 20 positioning.

Figure 9:
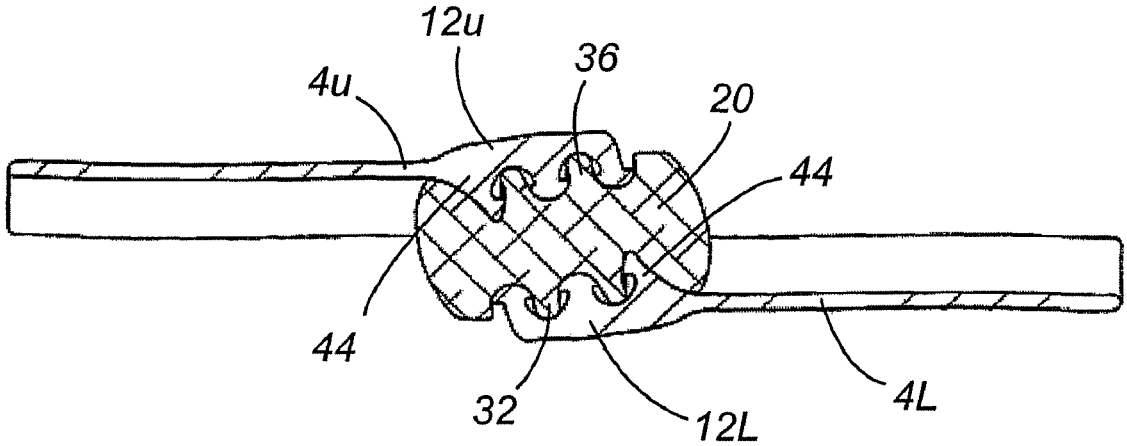
FIG. 9 is a cross-sectional view of FIG. 8.

Referring now to FIGS. 6-9, the intermediate member 20 is shown positioned between the upper fastening member 4U and a lower fastening member 4L. Here, it can be appreciated how the rails 16 of the upper fastening member 4U and the lower fastening member 4L engage the grooves 40 of the intermediate member 20. In addition, the upper contour 36 and lower contour 32 of the intermediate member 20 engage the spaces between each individual rail 44 of the lower rail fastener 12L and the upper rail fastener 12U. Thus, the intermediate member 20 blocks the gap between the upper fastening member 4U and the lower fastening member 4L, thereby substantially preventing the migration of liquid and/or gas between the two fastening members 4. FIG. 9 illustrates the relationship of the rail fastener rails 16 and how the upper contour 36 and the lower contour 32 of the intermediate member 20 may interact with the intermediate member grooves 40 of the intermediate member 20 such that some spacing is provided that reduces friction between the intermediate member 20 and the rail fastener 12 that aids in the transitioning of the intermediate member 20 along the rail fasteners.

Figure 11:
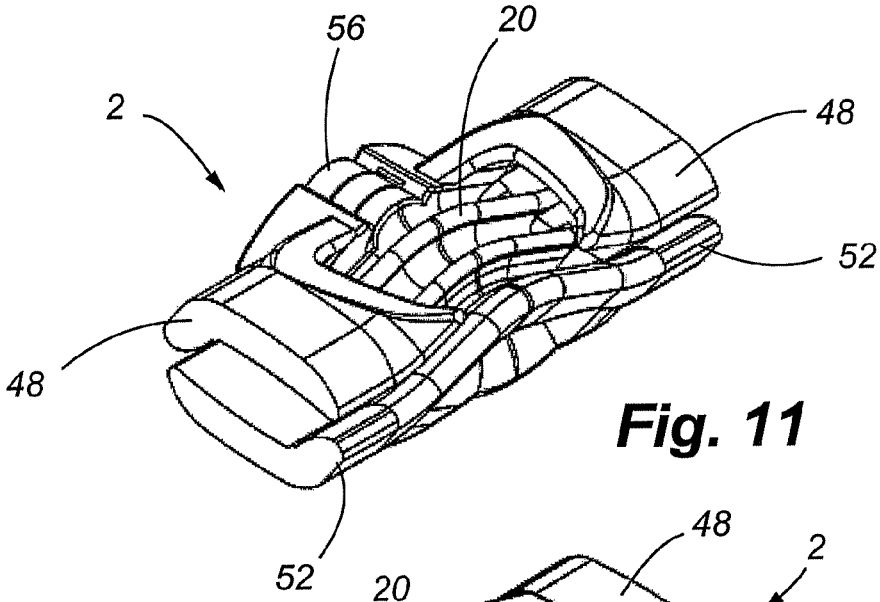
FIG. 11 is a rear perspective view of the sealing device shown in FIG. 10.
Figure 10:
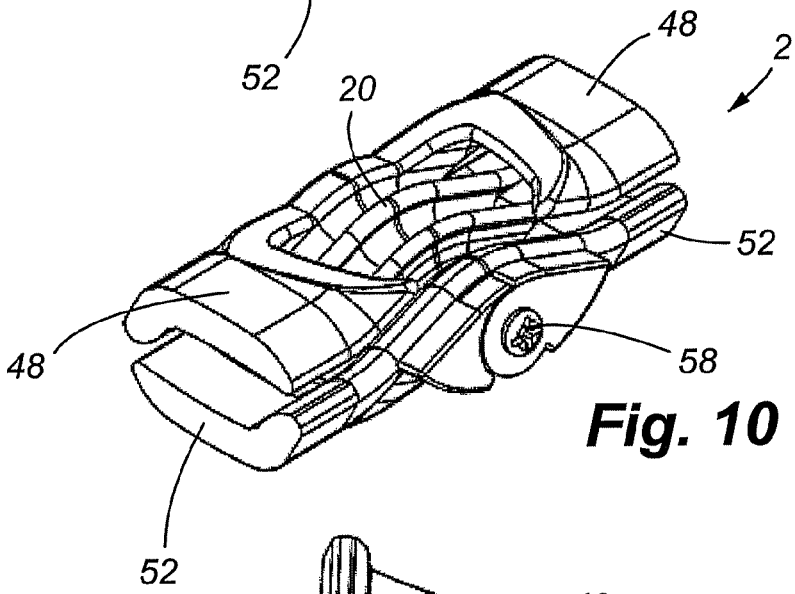
FIG. 10 is a front perspective view of the sealing device of one embodiment of the present invention.
Figure 12:
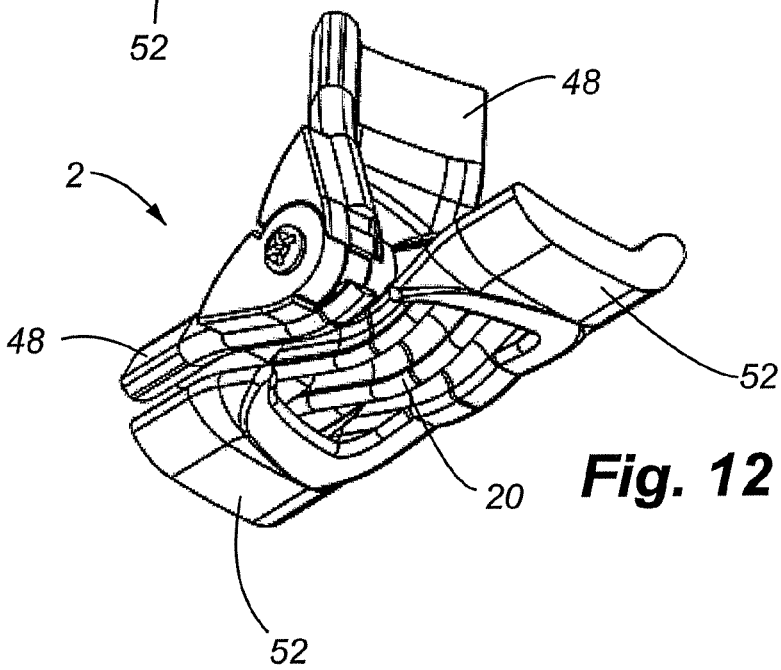
FIG. 12 is a bottom perspective view of the sealing device shown in FIG. 10 wherein a movable control arm is in a seal opening position.

Referring now to FIGS. 10-12, the sealing device 2 of one embodiment of the present invention is provided. More specifically, in order to reseal separated rail fasteners, a plurality of control arms are provided. In this example, movable control arms 48 and stationary control arms 52 are associated with the intermediate member 20. In operation, the stationary control arms 52 are located beneath the lower fastening member and the movable control arms 48 are located above the upper fastening member with the intermediate member 20 positioned between the upper fastening member and the lower fastening member. The movable control arms 48 are interconnected to the intermediate member 20 via a hinge 56. As used in describing some embodiments of the present invention, "hinge" refers to any pivotable connection including hinges, springs, or other moveable connections that allow movement relative to a fixed point. One skilled in the art will appreciate that a hinge may be a separate element or a bendable portion of a single element. Each stationary control arm 52 is preferably a one-piece structure that is fixedly interconnected to the intermediate member 20. One skilled in the art will appreciate however, that all but one of the control arms may be movable, three control arms may be movable, or all four movable control arms may be movable to allow for selective opening and closing of the seal from either side of the sealing device. One skilled in the art will also appreciate that the movable control arm 48 may include a locking feature that maintains it in an opening position of use or a closing position of use. It is also envisioned that the control arms may be removable such that when removed, sliding of the sealing device 2 will disconnect the rail fasteners. The removed control arm could then be re-attached to the intermediate member 20 to allow for re-sealing, or alternatively, discarded for single-use operations. As will be apparent upon review of the remainder of this disclosure, a set of movable and stationary control arms may be provided with attractive magnetic fields to maintain them in a closed position to help maintain the integrity of the seal. Further, although shown with a transverse hinge, one skilled in the art will appreciate that the hinge may be placed longitudinally in relation to the intermediate member 20 without departing from the scope of the invention.

Referring now to FIGS. 13-19, the operation of one embodiment of a sealing device 2 is provided. As described above, the intermediate member 20 provides the mechanism for separating the upper fastening member 4U and the lower fastening member 4L. In order to reseal the fastening members 4, the movable control arms 48 act in concert with the stationary control arms 52 to provide the required compressive force to interlock the rail fastener rails 16 as the sealing device 2 moves along the rail fasteners 12. Thus, as long as the movable control arms 48 are positioned in a first, closing, position of use adjacent to the stationary control arms 52, the seal will maintain its integrity regardless of the location of the sealing device 2 along the rail fastener 12. When one of the movable control arms 48 is moved to a second, opening, position of use, no force is provided to reconnect the upper rail fastener 12U and the lower rail fastener 12L as the sealing device 2 is transitioned, thus, the rail fasteners 4 are separated and the seal is broken.

Figure 13:
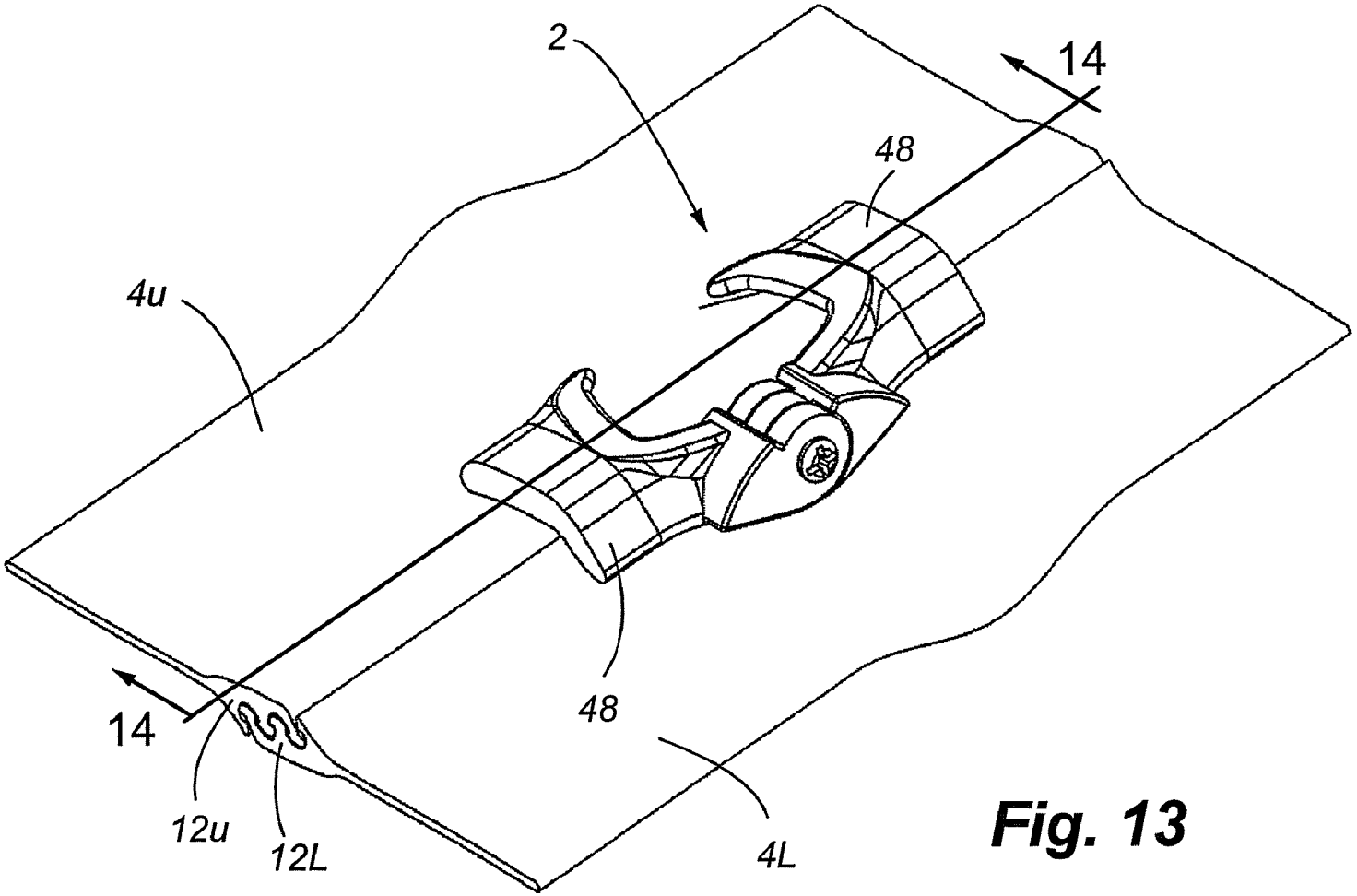
FIG. 13 is a perspective view of the sealing device associated with two fastening members.
Figure 14:
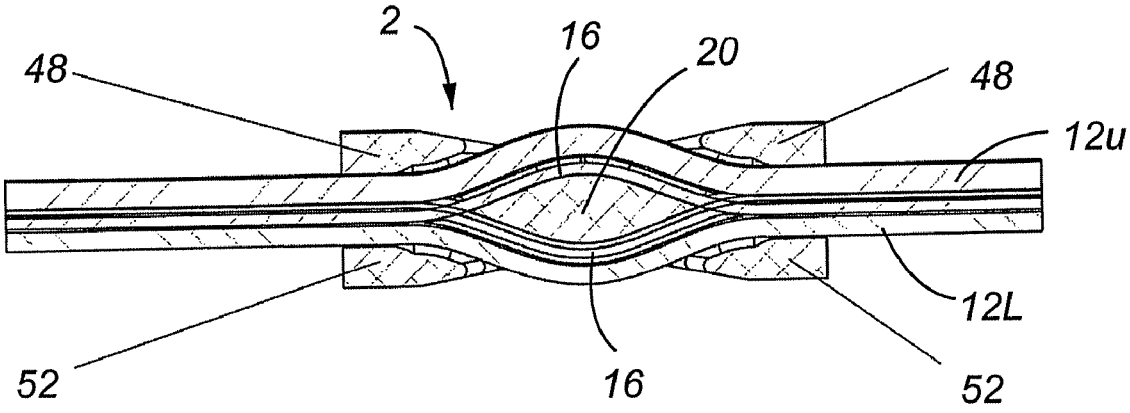
FIG. 14 is a cross-sectional view of FIG. 13.
Figure 15:
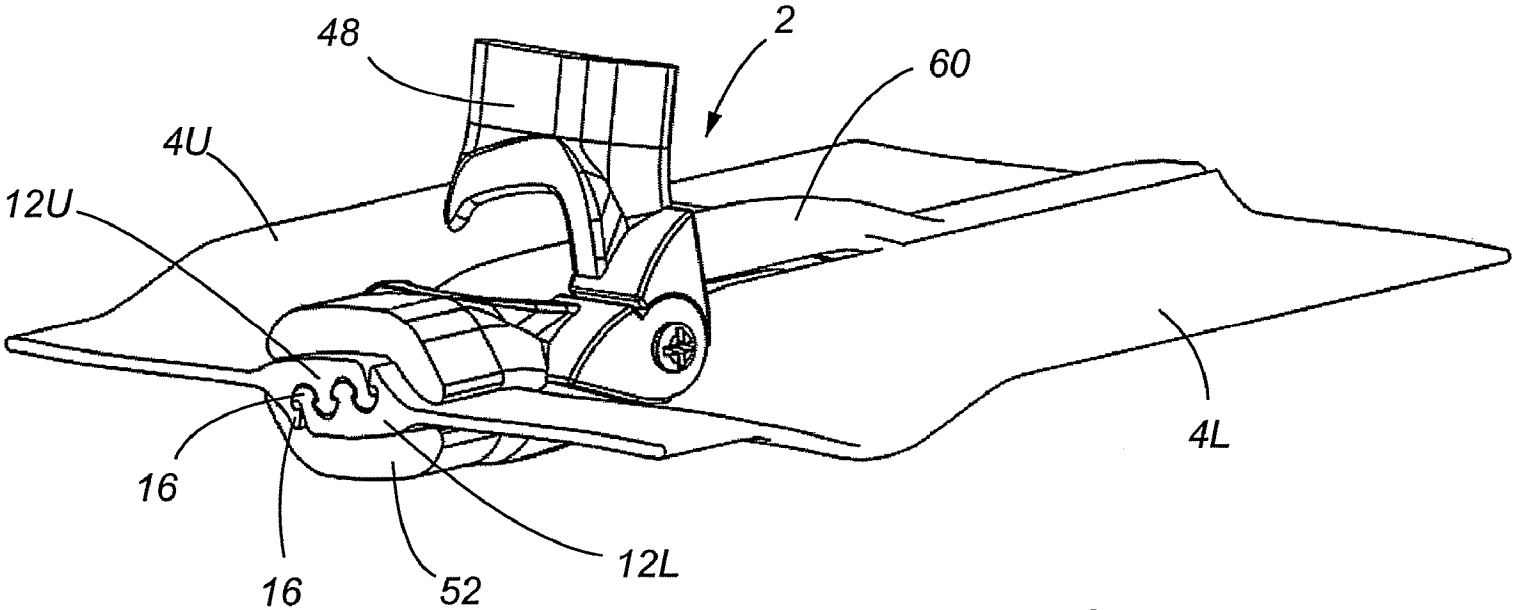
FIG. 15 is a perspective view similar to FIG. 13 wherein the movable control arm is positioned in a seal opening position.

Turning now specifically to FIGS. 13 and 14, a sealing device 2 interconnected to an upper fastening member 4U and a lower fastening member 4L is provided wherein the rails 16 fore and aft of the intermediate member 20 are interlocked and wherein the rails 16 engaged on the intermediate member 20 are separated. Here, the movable control arms 48 are positioned in the first, closing, position of use wherein the movable control arms 48 are adjacent to the stationary control arms 52 with the upper rail fastener 12U and the lower rail fastener 12L positioned therebetween. One skilled in the art will appreciate, with specific reference to FIG. 14, by moving the sealing device 2 either left of right with respect to the page, a gap 8 will be formed between the upper seal rail fastener 12U and the lower rail fastener 12L. However, the control arms will reseal the upper rail fasteners 12U and the lower rail fastener 12L as they pass by the gap 8. In order to open the seal, the movable control arm 48 is moved to a second, opening, position of use, thereby removing the force needed to seal the separated rail fasteners 12. Initially, when the movable control arm 48 is transitioned to the second position of use, a gap 8 is formed between the upper rail fastener 12U and a lower rail fastener 12L. As the sealing device 2 is transitioned away from the direction of the opened movable control arm 48, the gap 8 becomes a separation 60 between the upper rail fastener 12U and the lower rail fastener 12L which provides access into the bag, for example. Moving the sealing device 2, with the movable control arm 48 in the second, opening, position of use in the direction from which it started, the other movable control arm 48, which is in the first, closing, position of use, along with the associated stationary control arm 52 will reseal rail fasteners 12. It is understood that the moveable control arm 48 may be transitioned to an opening position via rotatable or translational movement with regard to the rail fastener 12. Once the sealing device 2 is positioned at its starting location, the movable control arm 48 is repositioned in the first, closing, position of use to seal the gap 8 between the upper rail fastener 12U and the lower rail fastener 12L.

Figure 16:
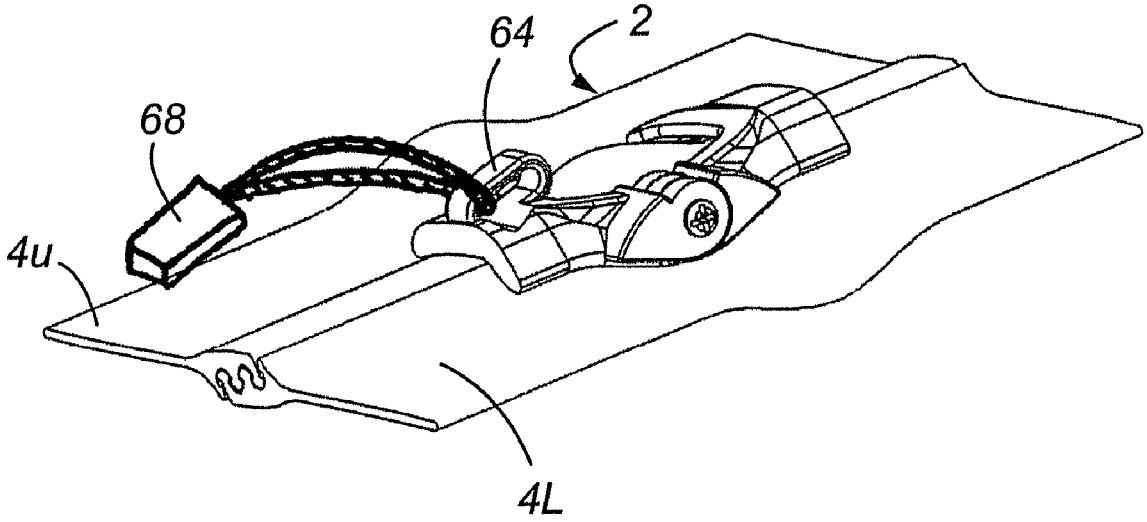
FIG. 16 is a perspective view of the sealing device that includes a pull tab.
Figure 17:
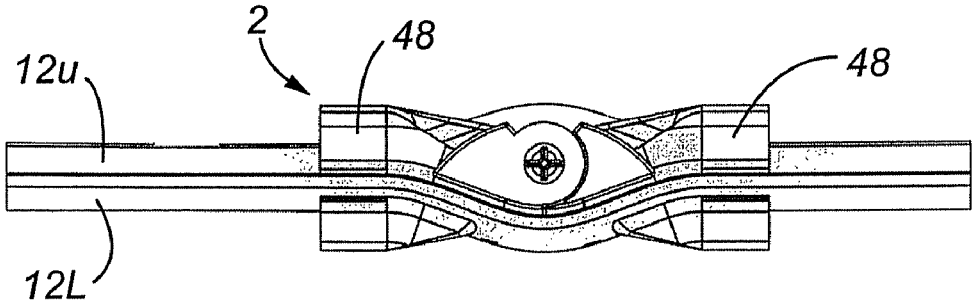
FIG. 17 is a right elevation view of the sealing device of FIG. 13 with the movable control arm in a seal closing position.
Figure 18:
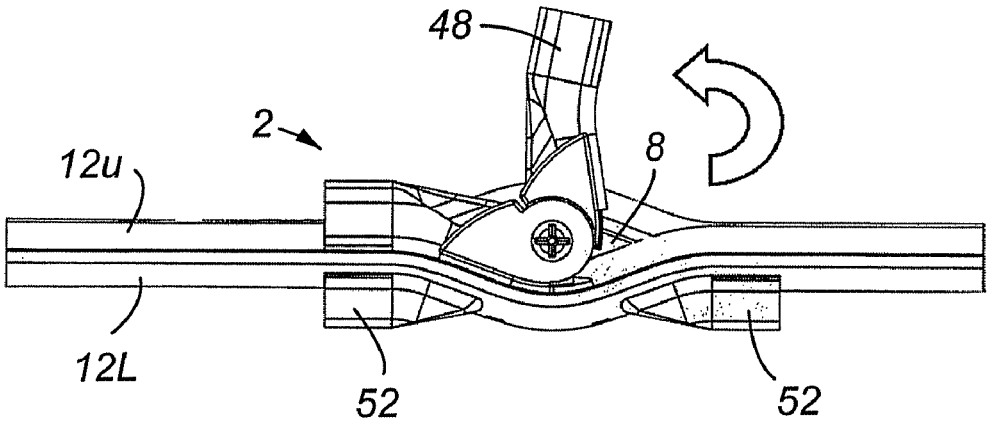
FIG. 18 is a right elevation view of the sealing device of FIG. 13 with the movable control arm in a seal opening position.
Figure 19:
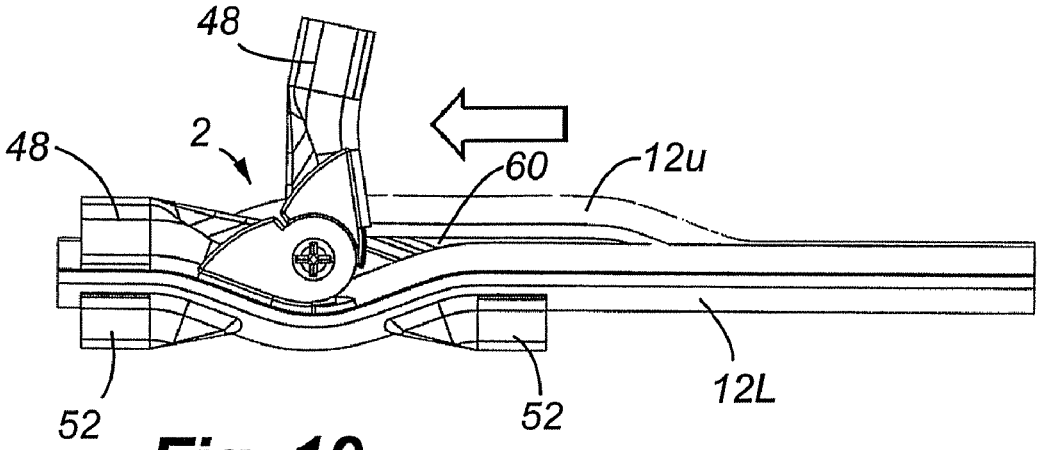
FIG. 19 is right elevation view of the sealing device of FIG. 13 with the movable control arm in a seal opening position and wherein the sealing device is being transitioned to create a separation between the fastening members.
Figure 20:
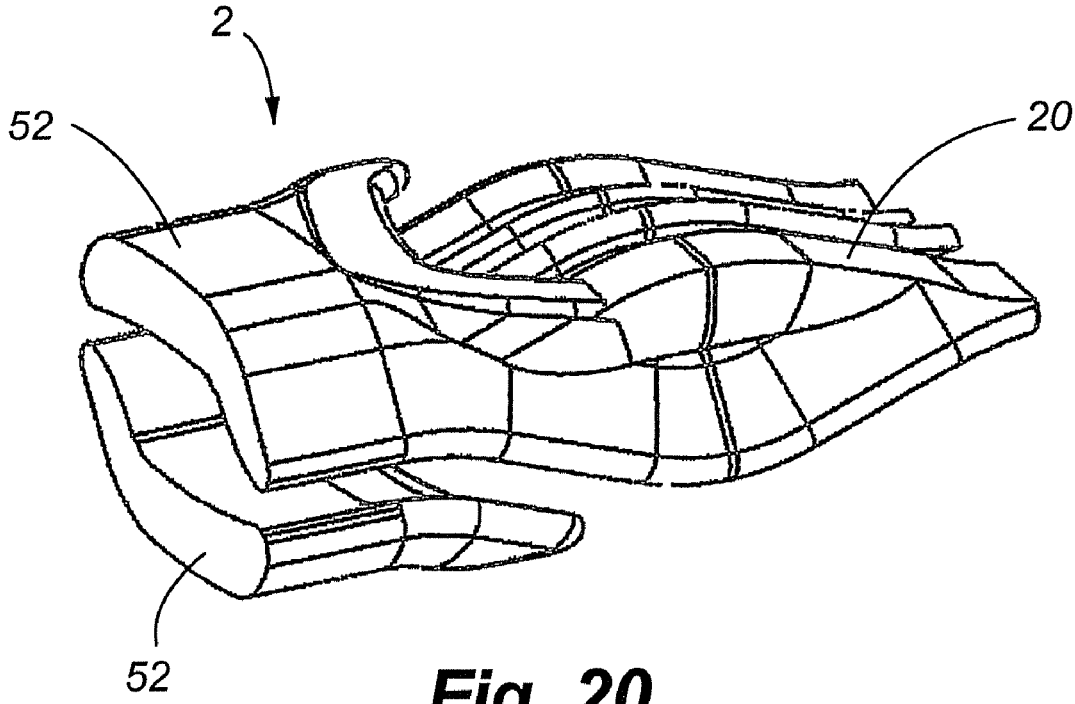
FIG. 20 is a perspective view of a sealing device of another embodiment of the present invention.
Figure 21:
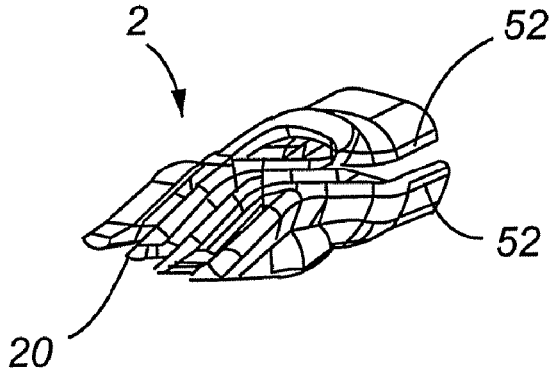
FIG. 21 is a rear perspective view of the sealing device shown in FIG. 20.
Figure 22:
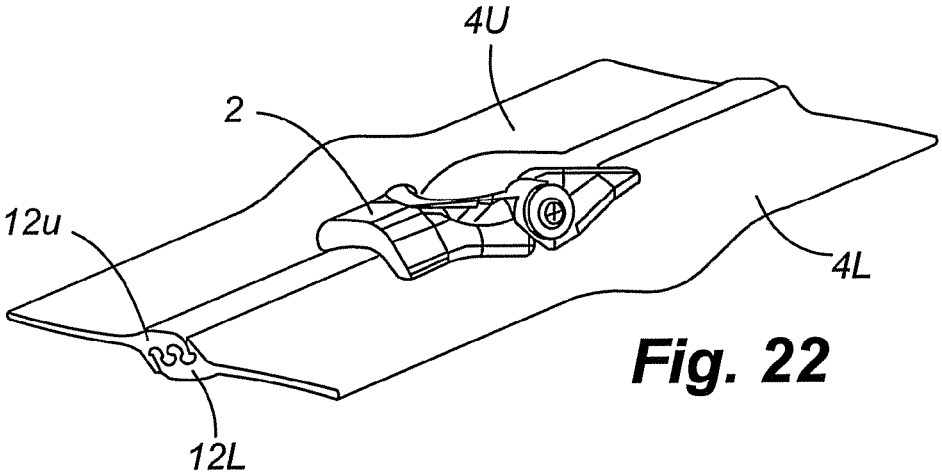
FIG. 22 is a top perspective view of the sealing device of FIG. 20 interconnecting two fastening members.
Figure 23:
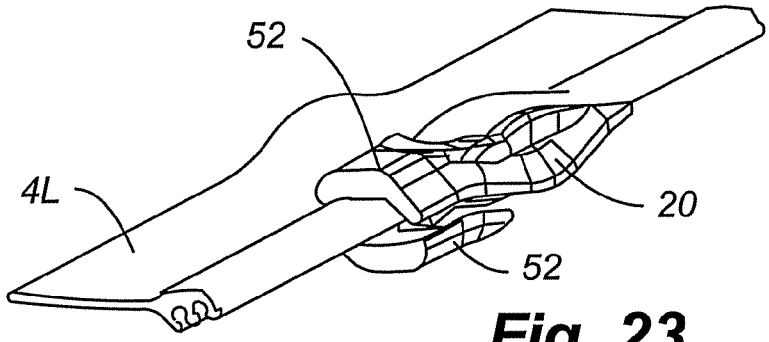
FIG. 23 is a top perspective view of the sealing device of FIG. 20 wherein the upper fastening member has been removed for clarity.
Figure 24:
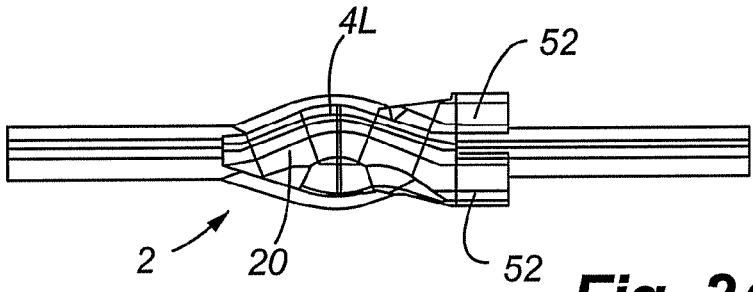
FIG. 24 is a left elevation view of the sealing device of FIG. 22.
Figure 25:
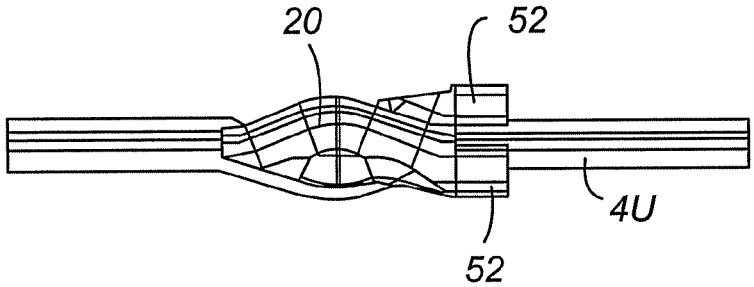
FIG. 25 is a left elevation view of the sealing device similar to that of FIG. 24 wherein the lower fastening member has been removed for clarity.
Figure 26:
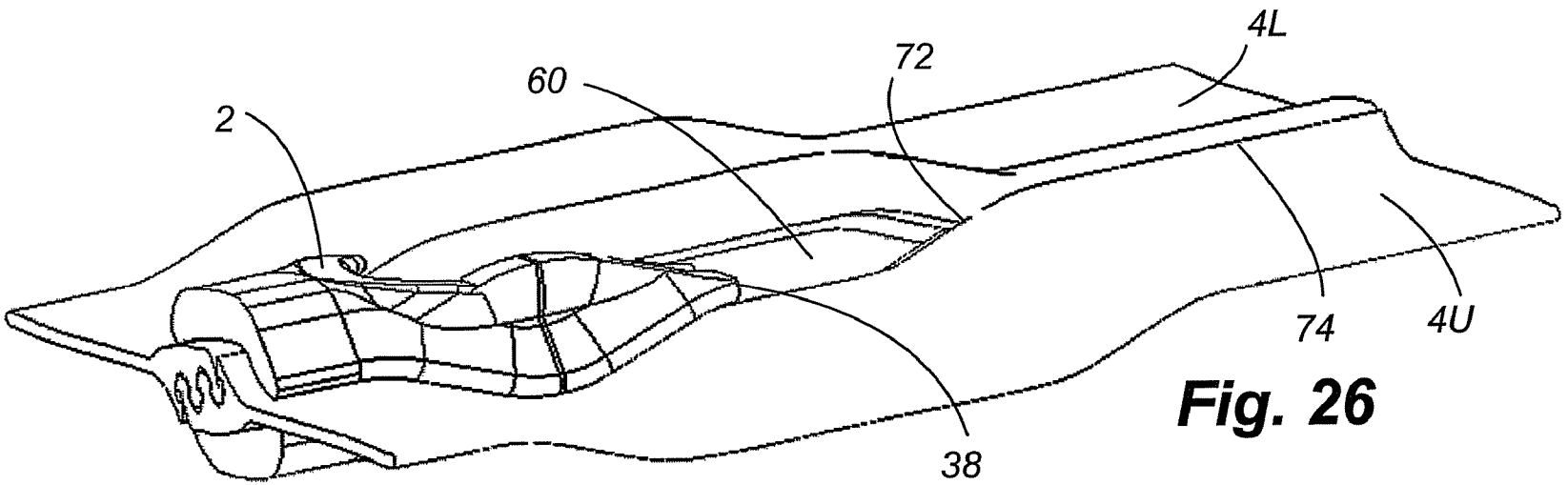
FIG. 26 is a perspective view of the sealing device of FIG. 20 positioned such that a separation is provided between the fastening members.
Figure 27:
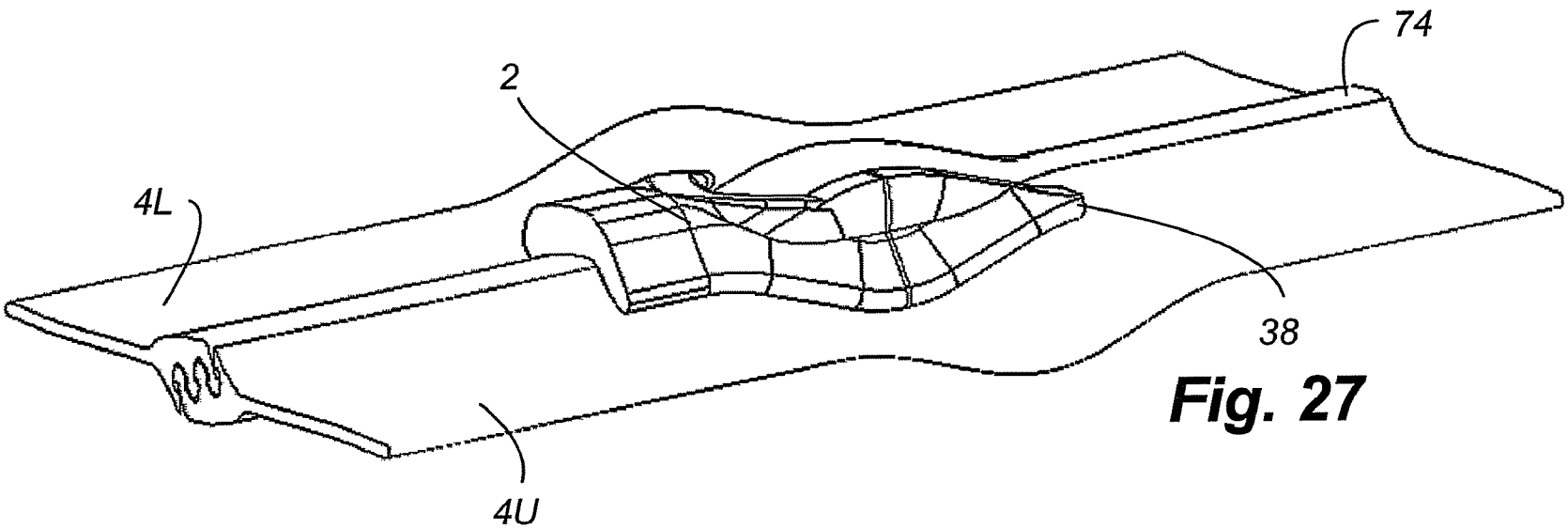
FIG. 27 is a perspective view of the sealing device of FIG. 20 positioned such that the two fastening members are interconnected and sealed.
Figure 28:
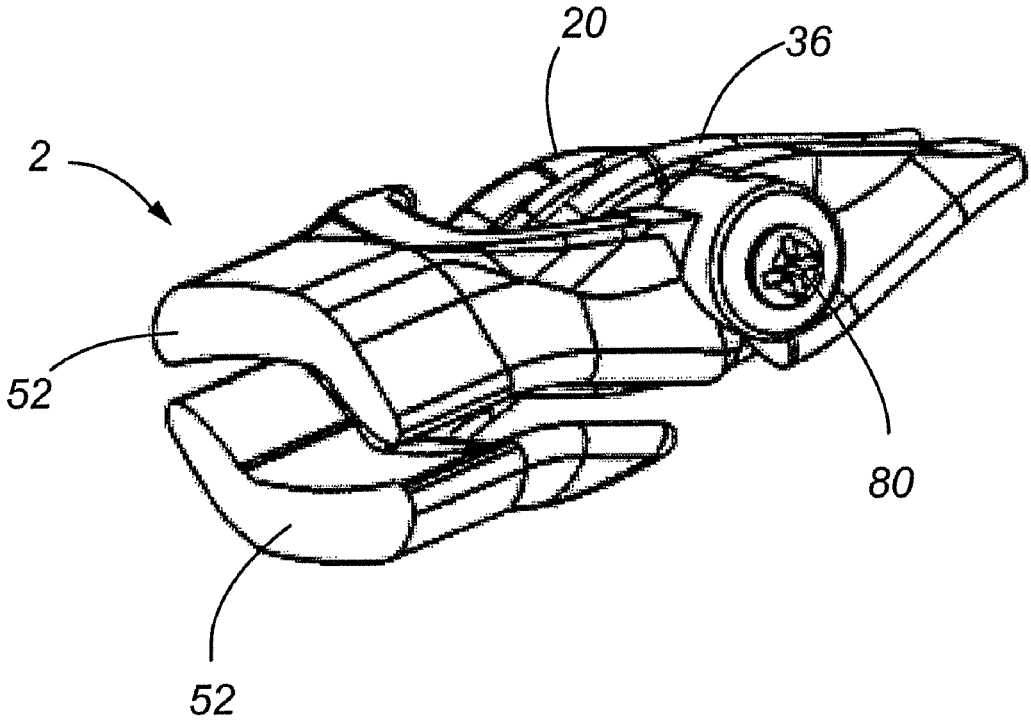
FIG. 28 is a front perspective view of a sealing device of another embodiment of the present invention similar to that shown in FIG. 20 but with a movable intermediate member.
Figure 29:
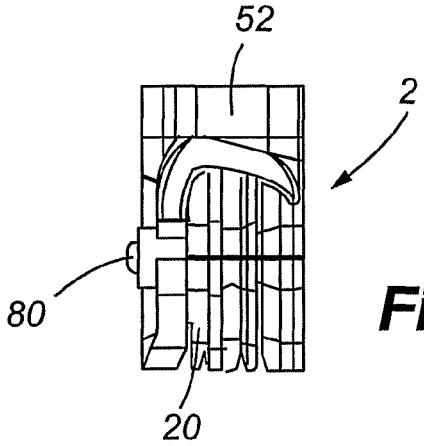
FIG. 29 is a top plan view of the sealing device shown in FIG. 28.
Figure 30:
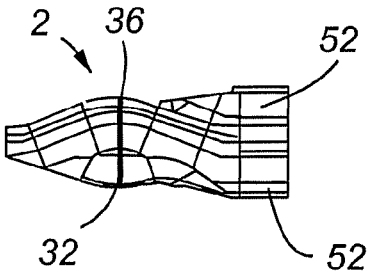
FIG. 30 is a right elevation view of the sealing device shown in FIG. 28.
Figure 31:
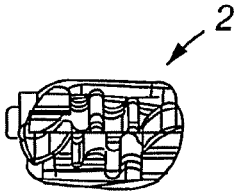
FIG. 31 is a front elevation view of the sealing device shown in FIG. 28.
Figure 32:
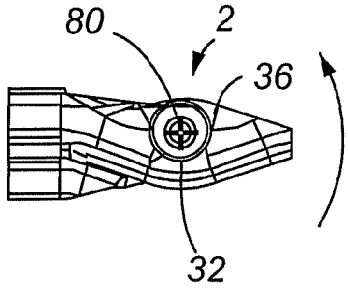
FIG. 32 is a left elevation view of the sealing device of the device shown in FIG. 28.

With specific reference to FIG. 16, one skilled in the art will appreciate that a pull tab sliding track 64 may be incorporated onto at least one of the movable control arms 48 that includes a pull tab 68 that facilitates the transitioning of the sealing device 2 along the rail fasteners 12.

Referring now to FIGS. 20-27, a one-way sealing device 2 is provided that employs two stationary control arms 52. More specifically, the intermediate member 20 of this embodiment is flanked by an upper stationary control arm and a lower stationary control arm. The stationary control arms are positioned on the same side (fore and aft) of the intermediate member and cooperate to seal the rail fasteners 12 when moved in a specific direction. When the sealing device 2 is moved in the opposite direction the intermediate member 20 separates the rail fasteners 12. In operation, with specific reference to FIGS. 26 and 27, the fastening members 4 may be interconnected to a coat, tent, bag, etc., wherein a permanent seal exists between the upper fastening member 4U and the lower fastening member 4L at a termination point 72. One skilled in the art will appreciate that the permanent seal may be made via a heat weld, ultrasonic weld, etc. As the sealing device 2 is moved, a separation 60 occurs between the upper fastening member 4U and a lower fastening member 4L, thereby providing access to the tent, bag, etc. By moving the fastening member 2 back to its starting point, a seal is re-established. That is, when the first leader end 38 of the intermediate member 20 contacts the termination point 72, a seal 74 is formed between the upper fastening member 4U and the lower fastening member 4L.

Referring now to FIGS. 28-48, yet another embodiment of the sealing device 2 is provided that employs a rotatable intermediate member 20. More specifically, the intermediate member 20 of this embodiment of the present invention is capable of selective rotation with respect to two stationary control arms 52, wherein the intermediate member 20 is attached to the control arms via a pivot 80. This intermediate member 20 is very similar to that described above wherein an upper contour 36 and a lower contour 32 are employed. However, in order to facilitate disconnection of the upper fastening member 4U and the lower fastening member 4L, the intermediate member 20 can be selectively rotated, preferably up to about 90°, to force the rail fasteners 12 open to provide a relatively larger gap and a separation as the intermediate member 20 is moved along the rail fasteners.

Figure 33:
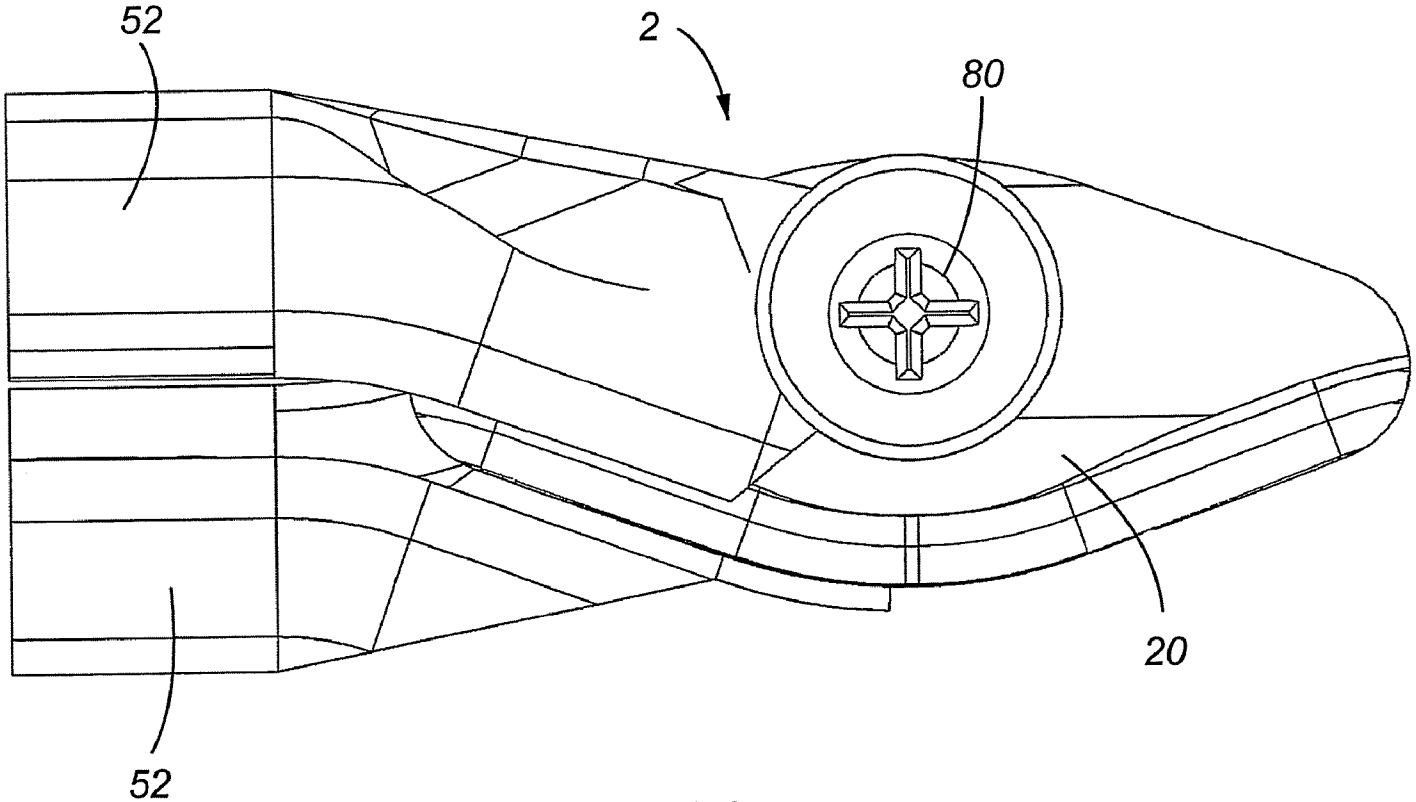
FIG. 33 is a left elevation view of the sealing device shown in FIG. 28 with an intermediate member in a first position of use.
Figure 34:
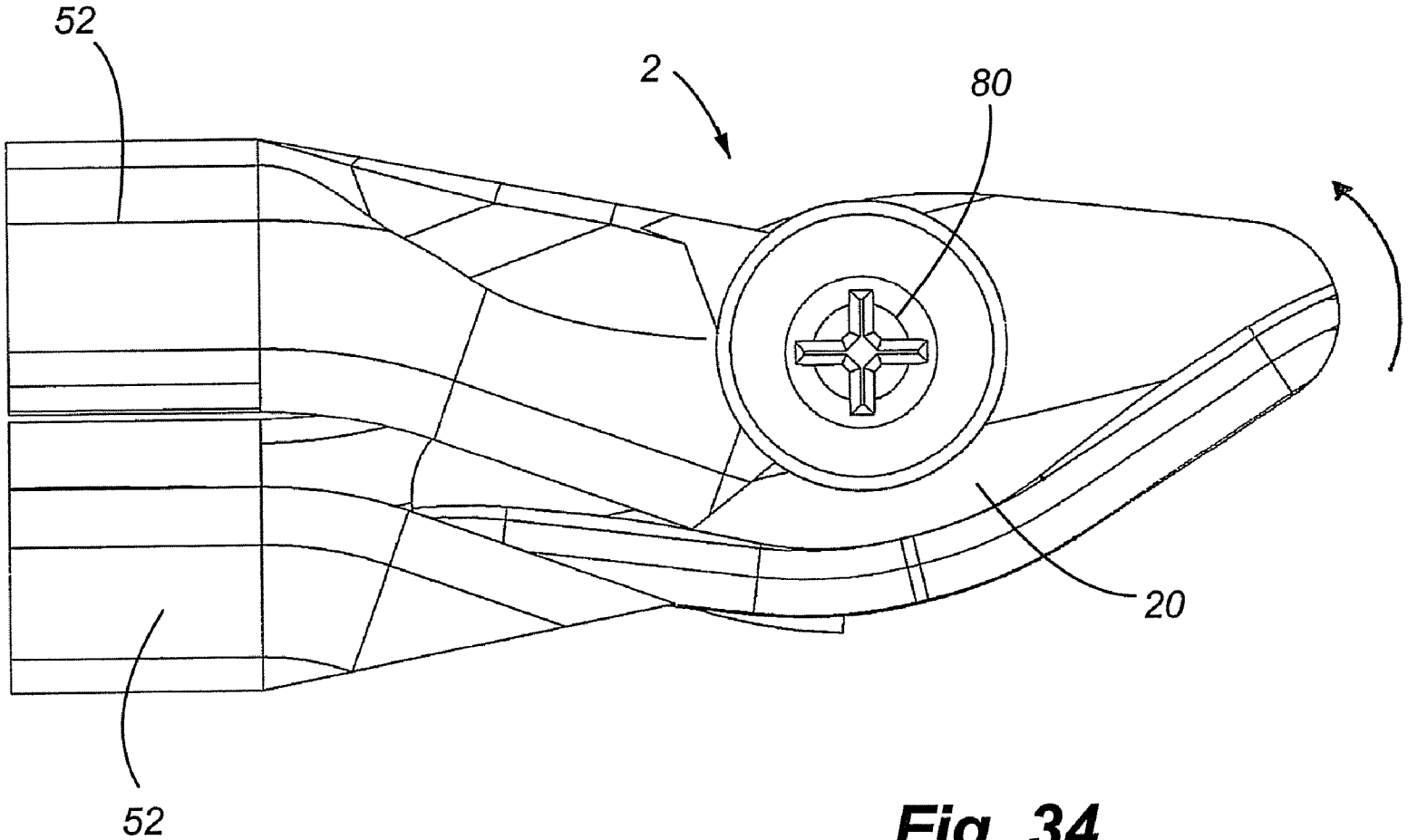
FIG. 34 is a left elevation view of the sealing device shown in FIG. 28 with an intermediate member in a second position of use.
Figure 35:
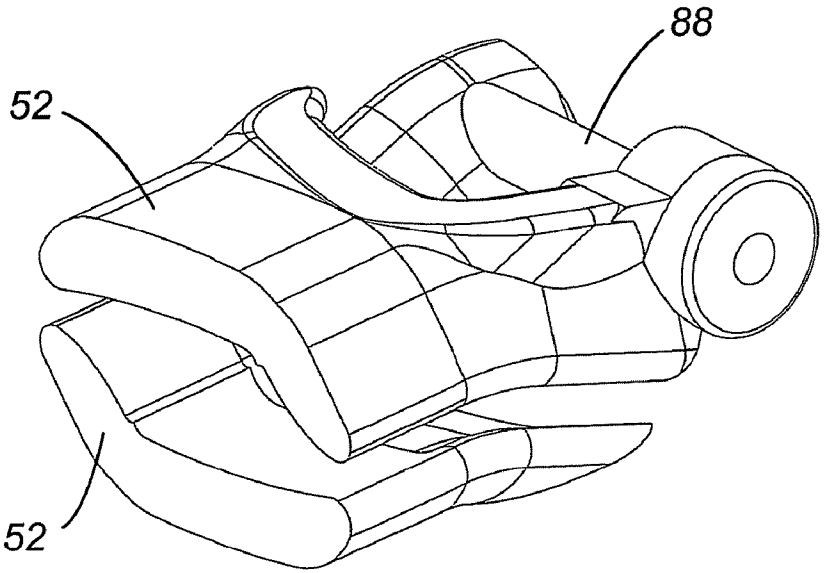
FIG. 35 is a perspective view of the stationary control arms of the sealing device of FIG. 28.
Figure 36:
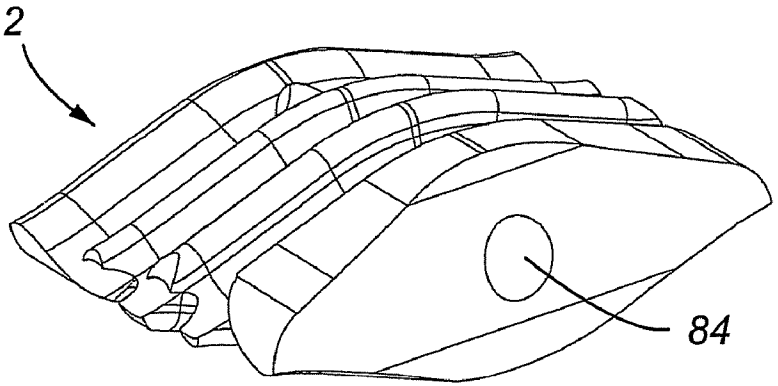
FIG. 36 is a perspective view of the rotatable intermediate member employed by the sealing device of FIG. 28.
Figure 38:
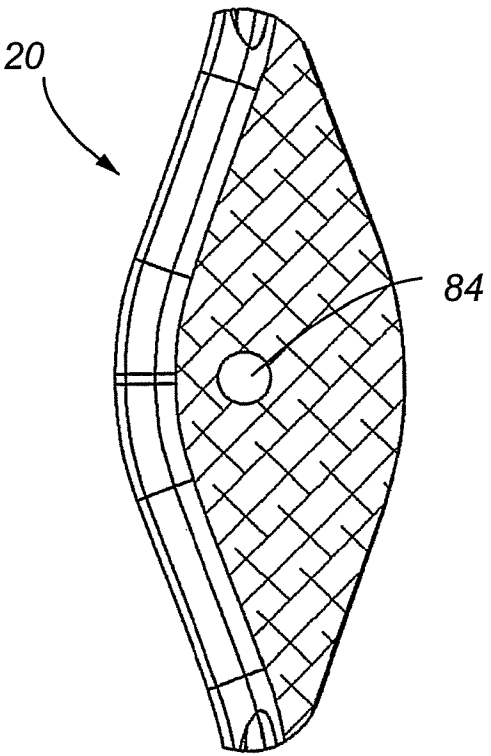
FIG. 38 is a right elevation view of the rotatable intermediate member shown in FIG. 36.
Figure 37:
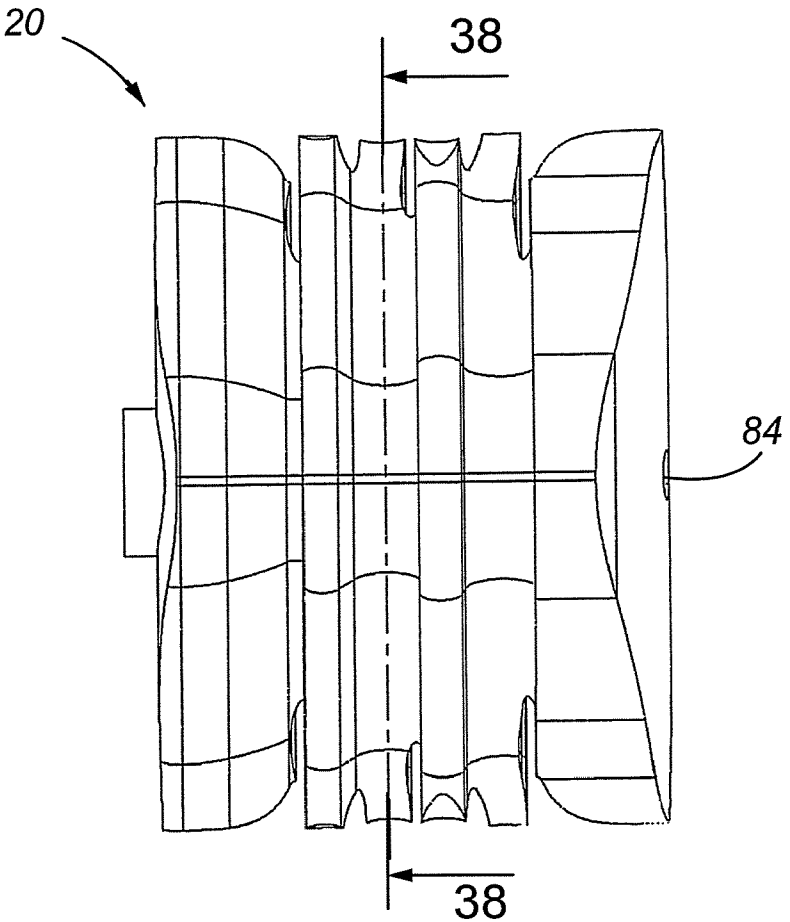
FIG. 37 is a top plan view of the rotatable intermediate member shown in FIG. 36.
Figure 39:
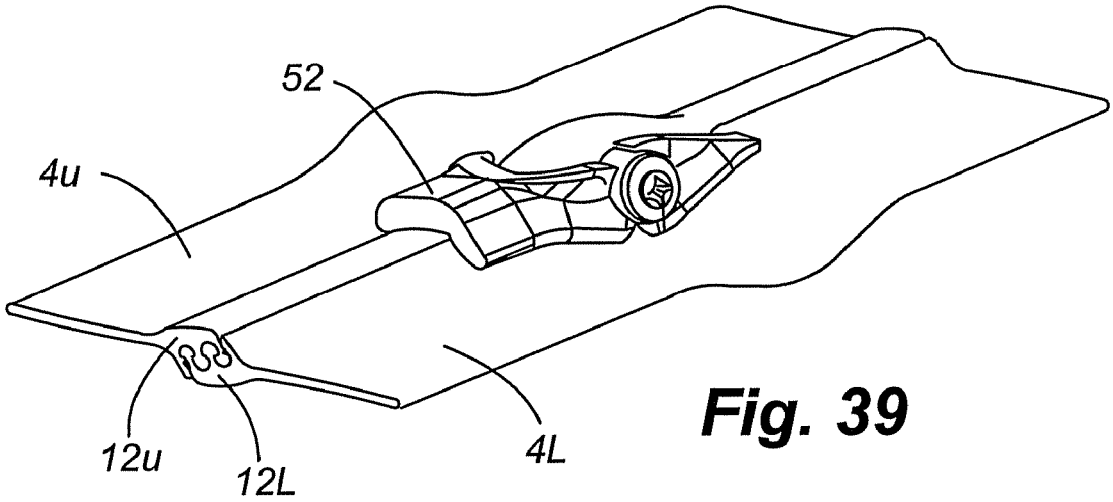
FIG. 39 is a top perspective view of the sealing device of FIG. 28 interconnecting two fastening members.
Figure 40:
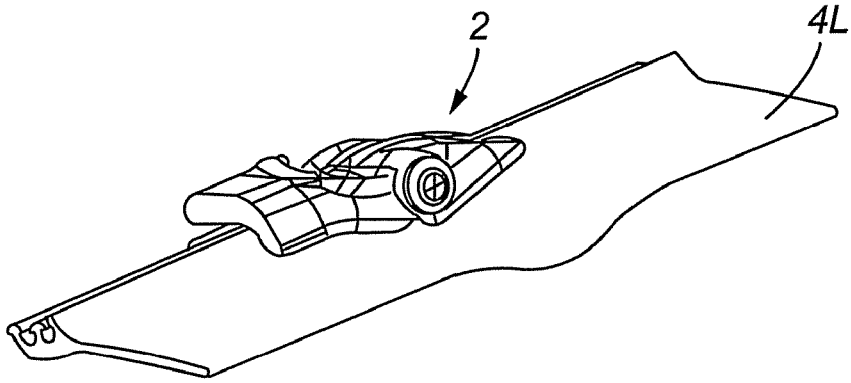
FIG. 40 is a top perspective view similar to that of FIG. 39 wherein the upper fastening member has been removed for clarity.
Figure 41:
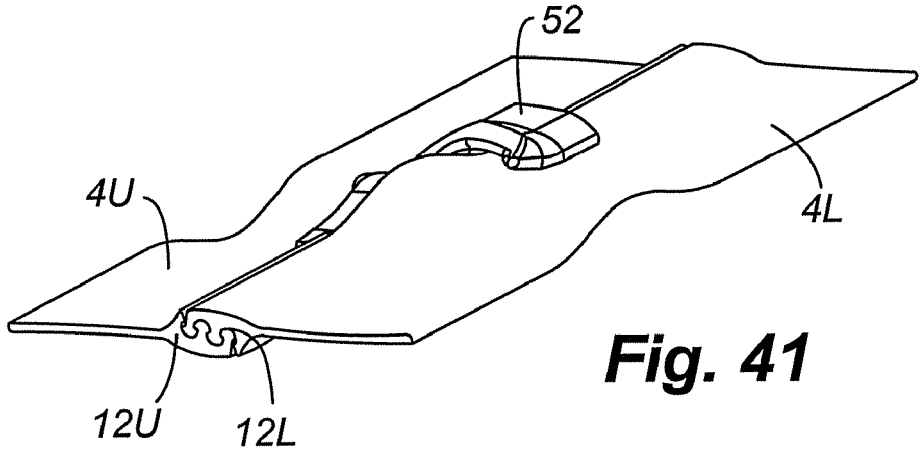
FIG. 41 is a bottom perspective view of the sealing device of FIG. 28 interconnecting two fastening members.
Figure 42:
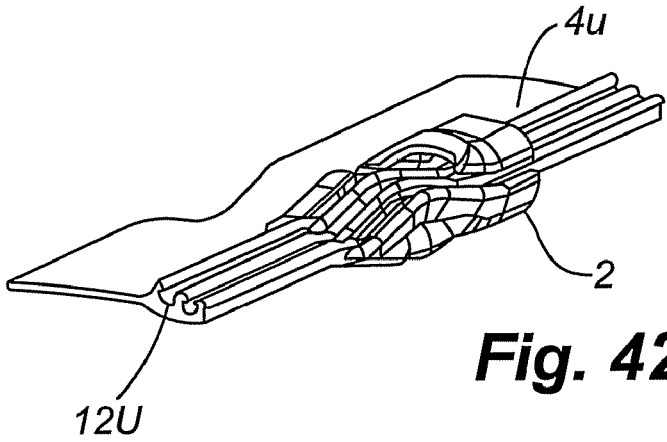
FIG. 42 is a bottom perspective view similar to that of FIG. 41 wherein the upper fastening member has been removed for clarity.

With specific reference to FIGS. 33 and 34, the intermediate member 20 of this embodiment is shown in a first, non-rotated, position of use and a second, rotated, position of use, respectively. This embodiment of the present invention has the advantage of allowing for disengagement of the upper fastening member 4U and the lower fastening member 4L regardless of which side of the seal the sealing device 2 is accessed. In addition, by being able to rotate the intermediate member 20, the contours of the intermediate member 20 and rail fasteners 12 are exposed to aid in cleaning, thereby helping maintain a tight seal by removing any foreign objects that would affect the integrity of the seal.

With specific reference to FIGS. 35-38, the component parts of this embodiment of the present invention are shown. Here, the intermediate member 20 includes an aperture 84 for rotatable engagement to a shaft 88 that interconnects the two stationary control arms 52. One skilled in the art will appreciate that in order to facilitate movement of the intermediate member 20 along the rail fasteners, one or more of the control arms may also be rotatably interconnected to the shaft 88.

Figure 43:
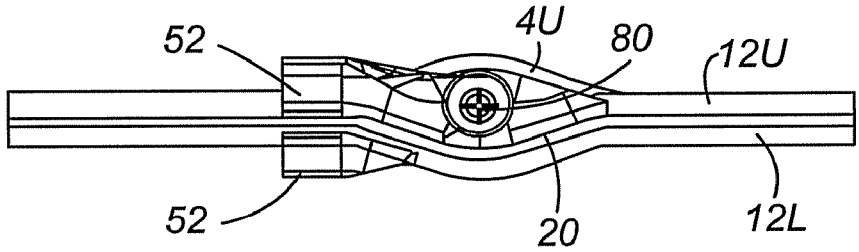
FIG. 43 is a right elevation view of the sealing device of FIG. 39.
Figure 44:
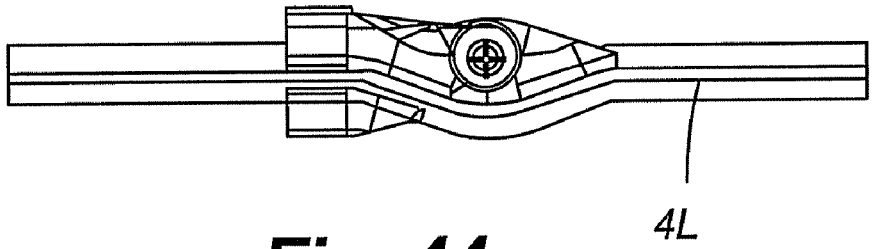
FIG. 44 is a right elevation view similar to that of FIG. 43 wherein the upper fastening member has been removed for clarity.
Figure 45:
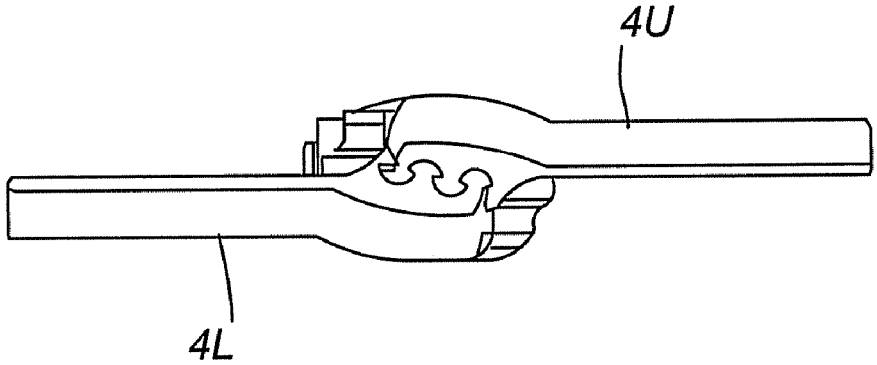
FIG. 45 is a front elevation view of FIG. 39.
Figure 46:
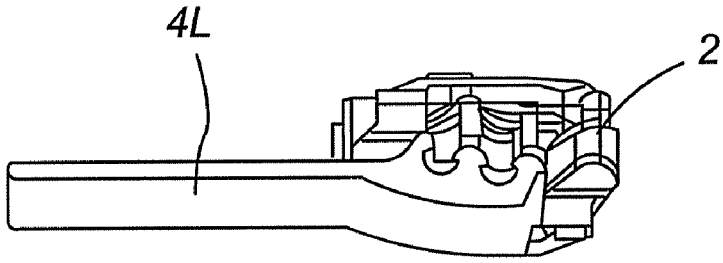
FIG. 46 is a front elevation view similar to that if FIG. 44 wherein the upper fastening member has been removed for clarity.
Figure 47:
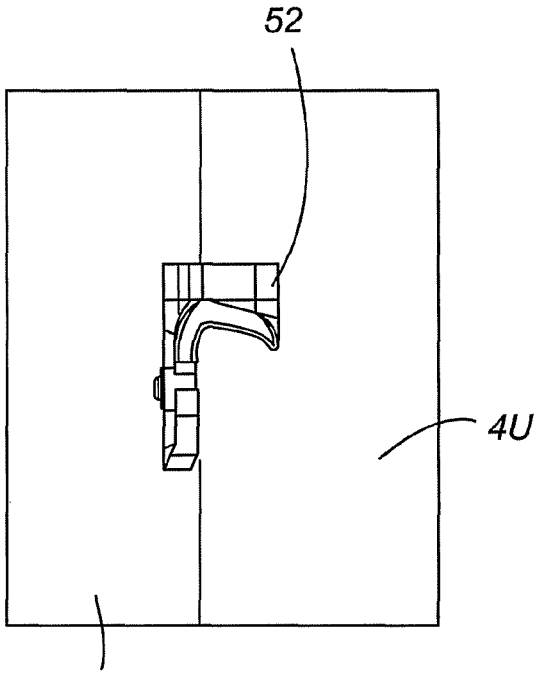
FIG. 47 is a top plan view of FIG. 39.
Figure 48:
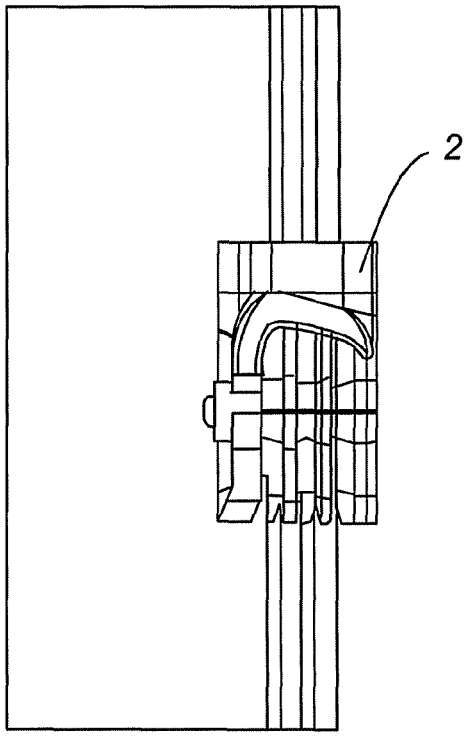
FIG. 48 is a top plan view similar to that of FIG. 46 wherein the upper fastening member has been removed for clarity.
Figure 56:
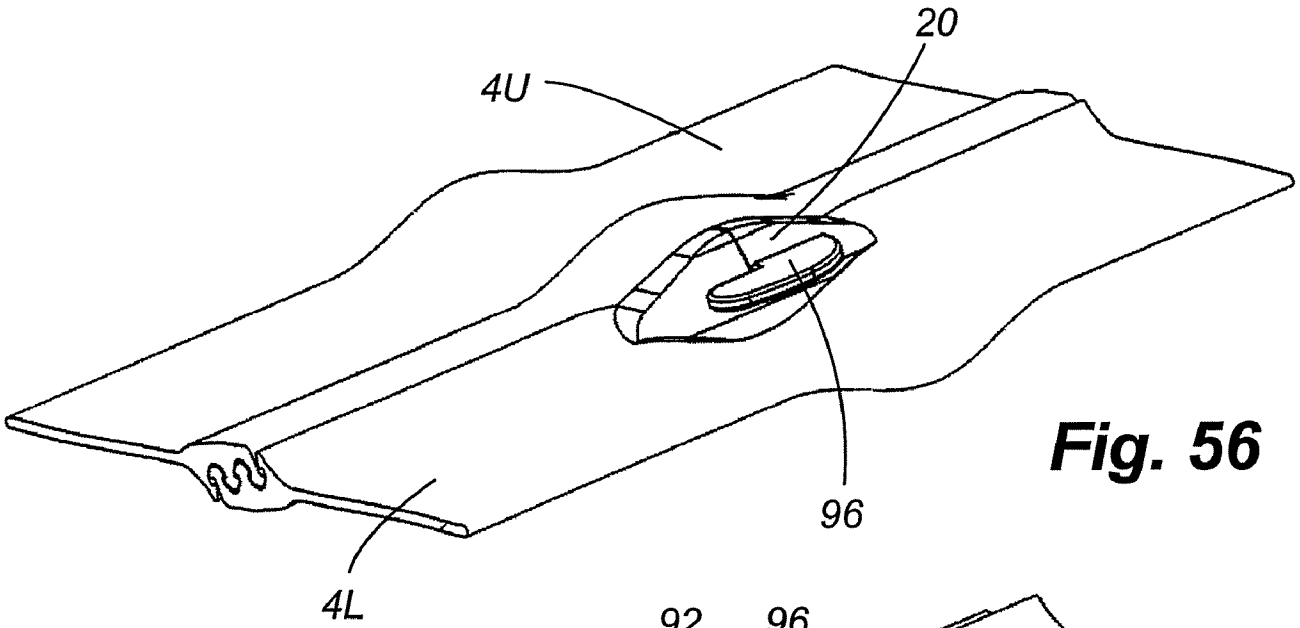
FIG. 56 is a top perspective view of the intermediate member of FIG. 49 interconnecting two fastening members.
Figure 57:
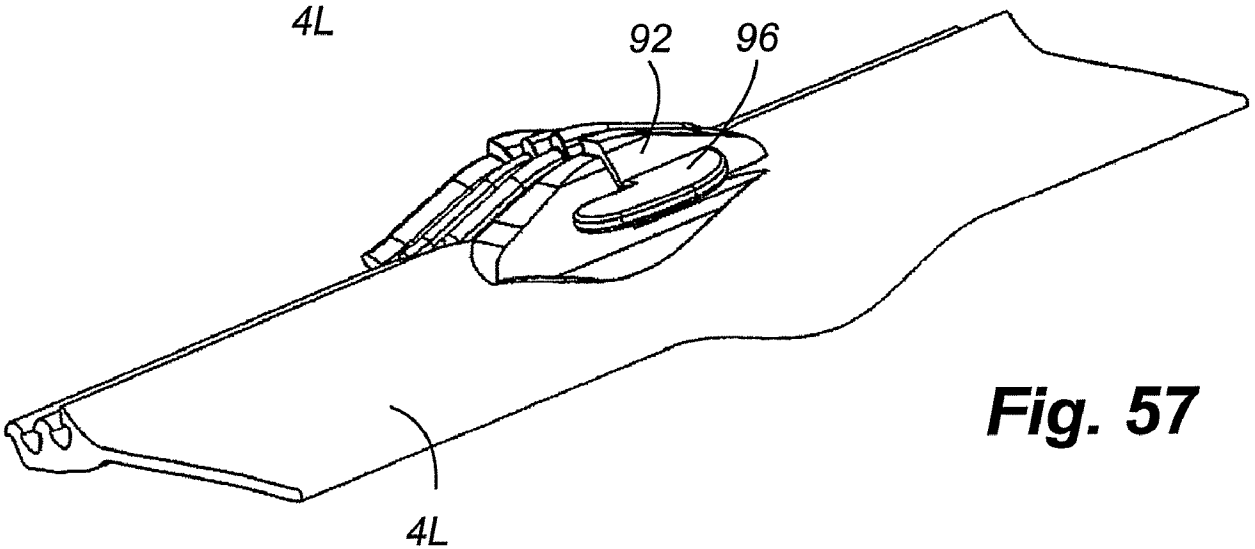
FIG. 57 is a top perspective view similar to that of FIG. 56 wherein the upper fastening member has been removed for clarity.
Figure 58:
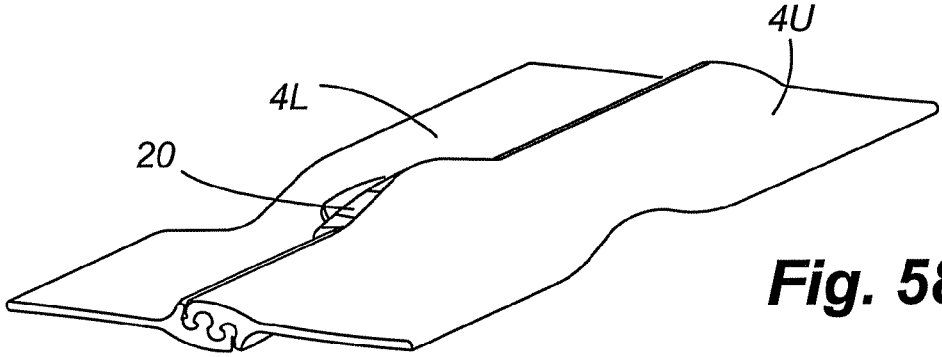
FIG. 58 is a rear perspective view of the intermediate member of FIG. 49 interconnecting two fastening members.
Figure 59:
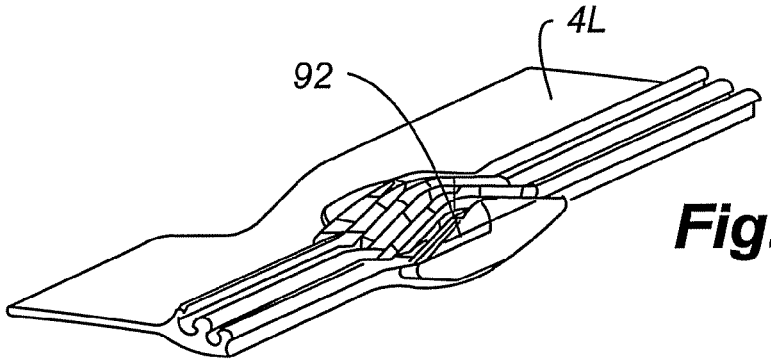
FIG. 59 is a rear perspective view similar to that of FIG. 58 wherein the upper fastening member has been removed for clarity.
Figure 60:
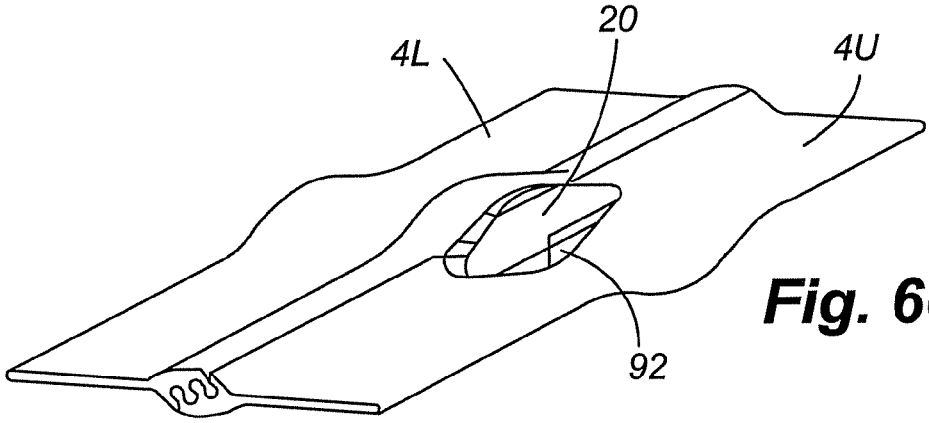
FIG. 60 is a bottom perspective view of the intermediate member of FIG. 49 interconnecting two fastening members.
Figure 61:
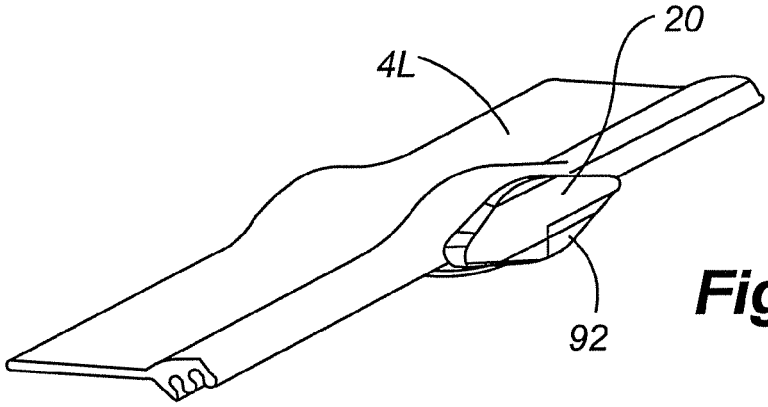
FIG. 61 is a bottom perspective view similar to that of FIG. 60 wherein the upper fastening member has been removed for clarity.
Figure 62:
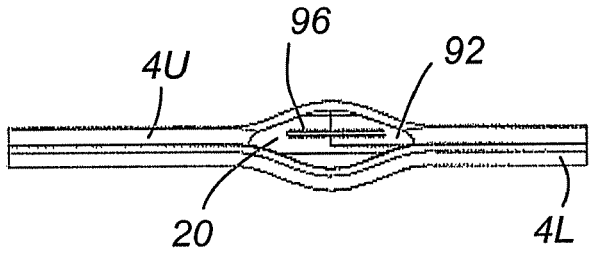
FIG. 62 is a right elevation view of FIG. 56.
Figure 63:
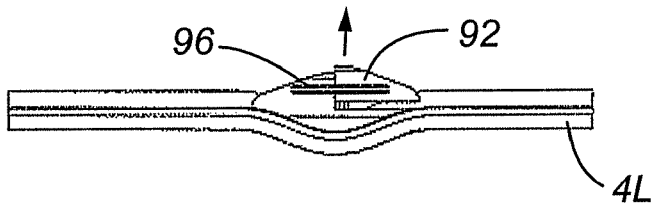
FIG. 63 is a right elevation view similar to that of FIG. 62 wherein the upper fastening member has been removed for clarity.
Figure 64:
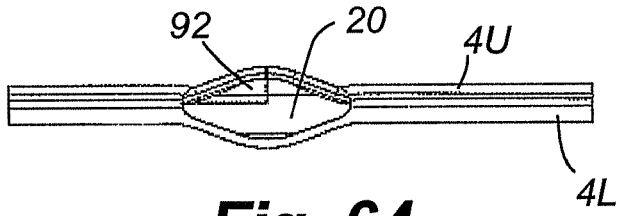
FIG. 64 is a left elevation view of FIG. 56.
Figure 65:
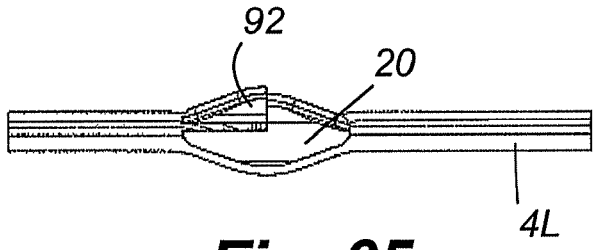
FIG. 65 is a left elevation view similar to that of FIG. 64 wherein the upper fastening member has been removed for clarity.
Figure 66:
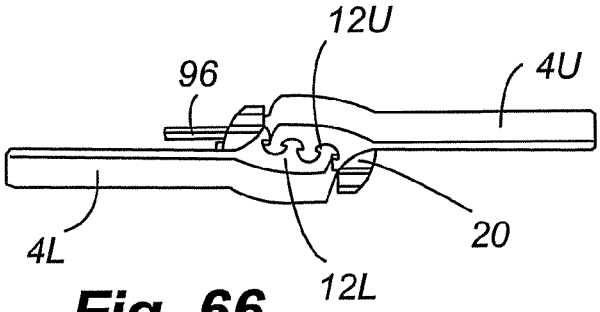
FIG. 66 is a front elevation view of FIG. 56.
Figure 67:
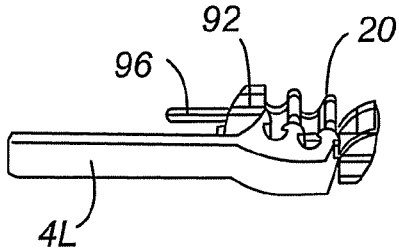
FIG. 67 is a front elevation view similar to that of FIG. 66 wherein the upper fastening member has been removed for clarity.
Figure 68:
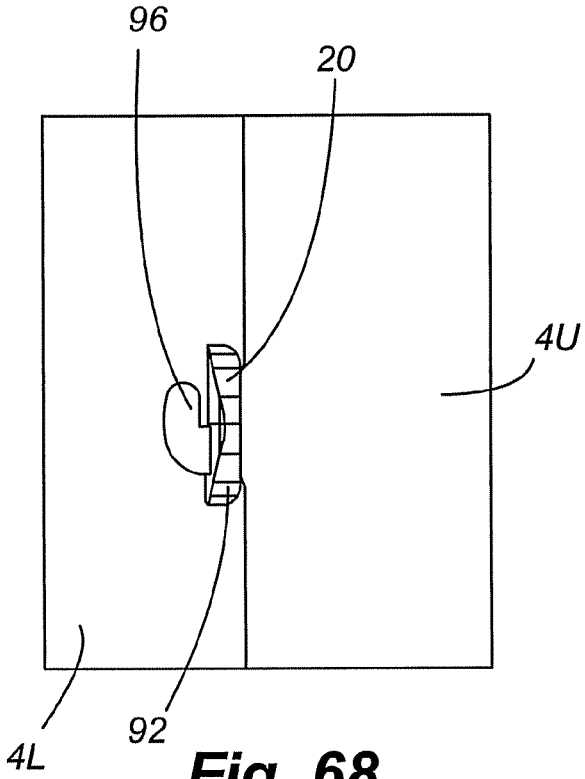
FIG. 68 is a top elevation view of FIG. 56.
Figure 69:
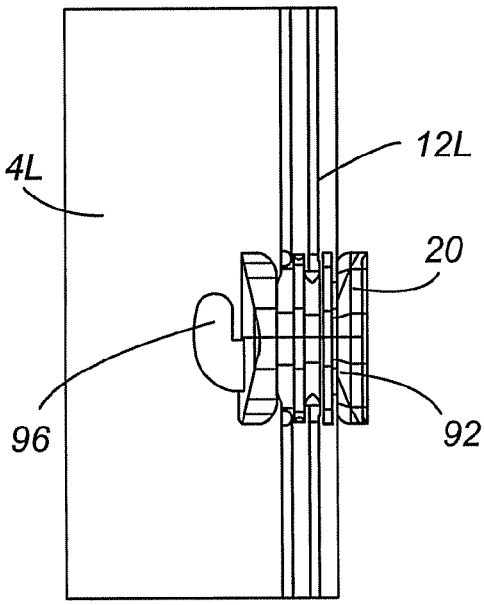
FIG. 69 is a top elevation view similar to that of FIG. 68 wherein the upper fastening member has been removed for clarity.
Figure 71:
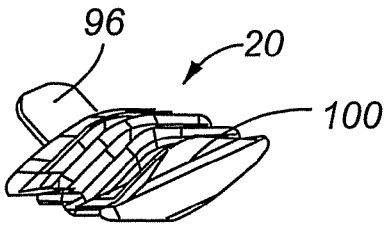
FIG. 71 is a rear perspective view of FIG. 70.
Figure 70:
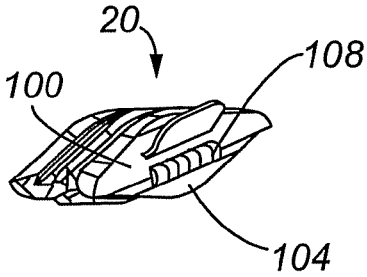
FIG. 70 is a front perspective view of an intermediate member of another embodiment of the present invention that has a clam shell arrangement.
Figure 72:
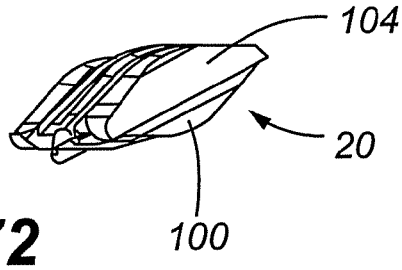
FIG. 72 is a bottom perspective view of FIG. 70.
Figure 73:
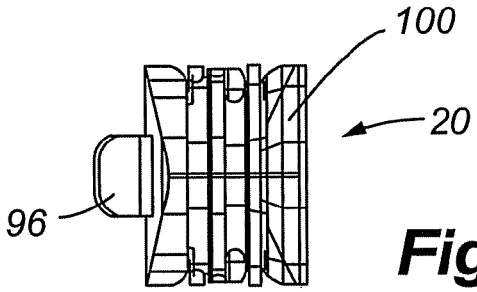
FIG. 73 is a top perspective view of the intermediate member shown in FIG. 70.
Figure 74:
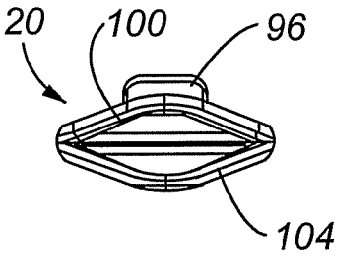
FIG. 74 is a right elevation view of the intermediate member shown in FIG. 70.
Figure 75:
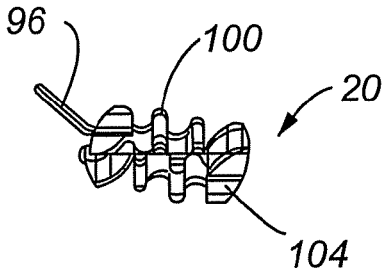
FIG. 75 is a front elevation view of the intermediate member shown in FIG. 70.
Figure 76:
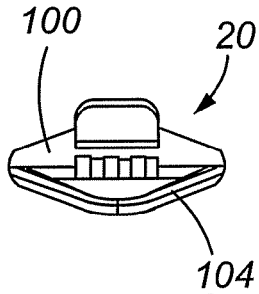
FIG. 76 is a left elevation view of the intermediate member shown in FIG. 70.
Figure 77:
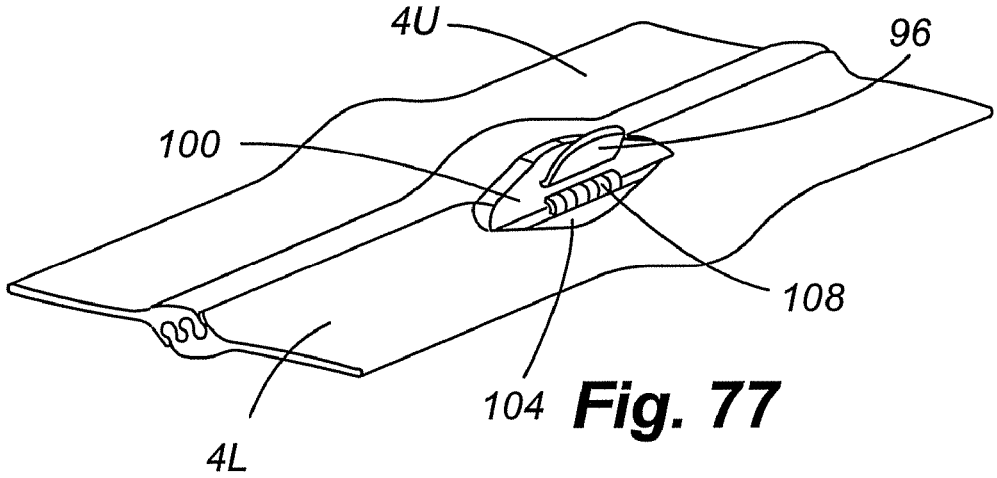
FIG. 77 is a top perspective view of the intermediate member shown in FIG. 70 interconnecting two fastening members.
Figure 78:
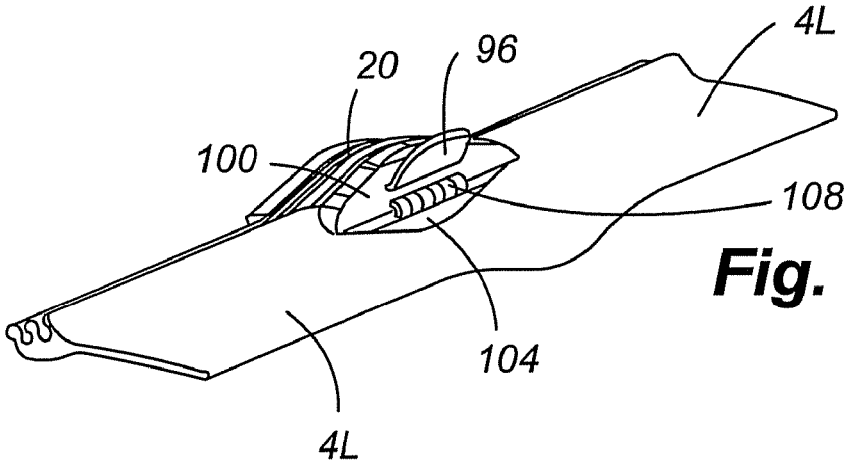
FIG. 78 is a top perspective view similar to that of FIG. 77 wherein the upper fastening member has been removed for clarity.
Figure 79:
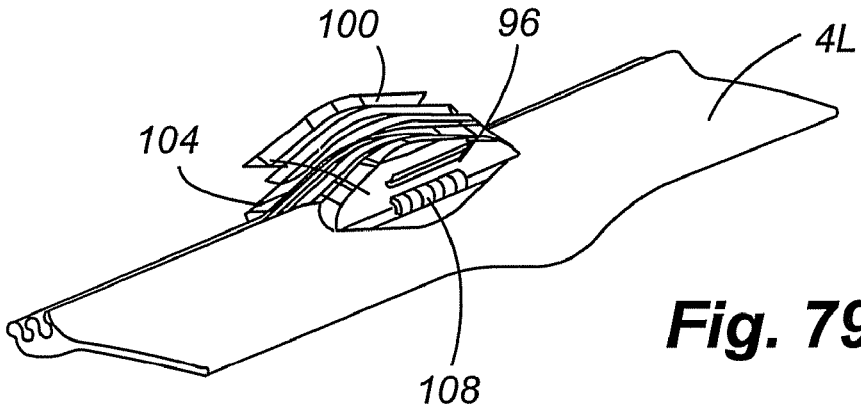
FIG. 79 is a top perspective view similar to that of FIG. 78 wherein the intermediate member is in an open position of use.
Figure 80:
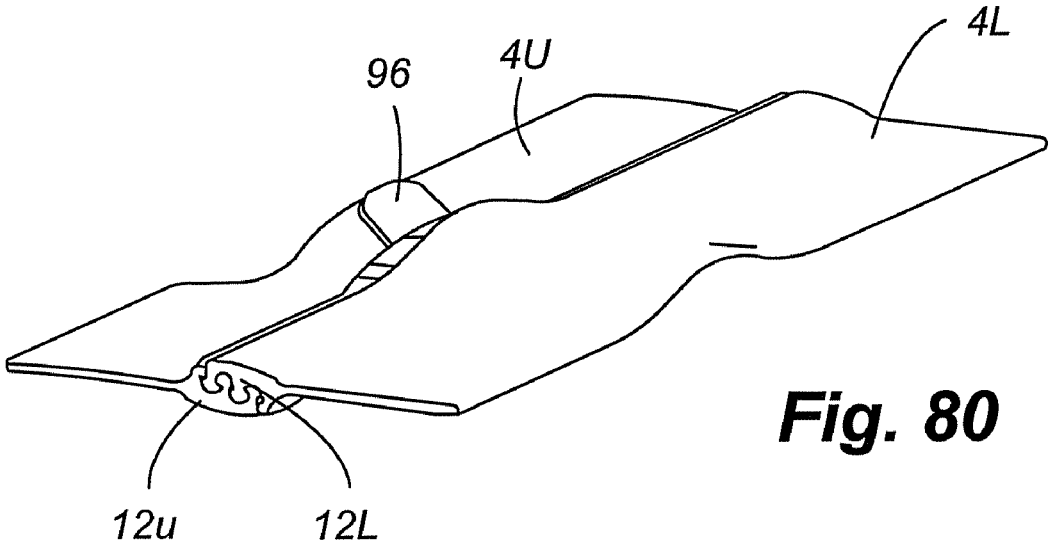
FIG. 80 is a rear perspective view of the intermediate member shown in FIG. 70 interconnecting two fastening members.
Figure 81:
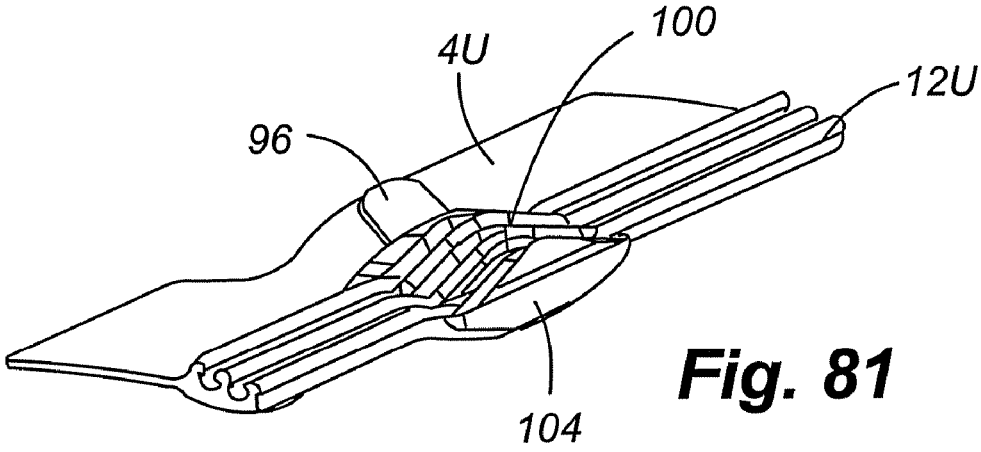
FIG. 81 is a rear perspective view similar to that of FIG. 80 wherein the lower fastening member has been removed for clarity.
Figure 82:
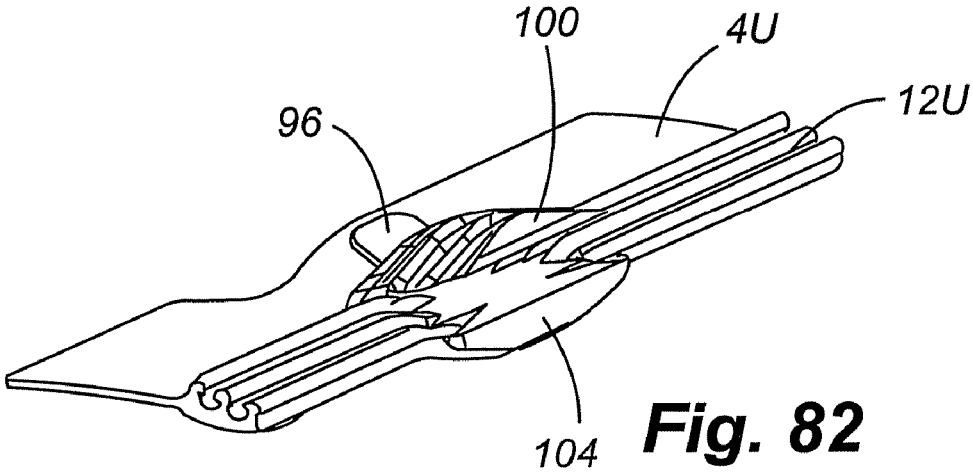
FIG. 82 is a rear perspective view similar to that of FIG. 81 wherein the intermediate member is shown in an open position of use.
Figure 83:
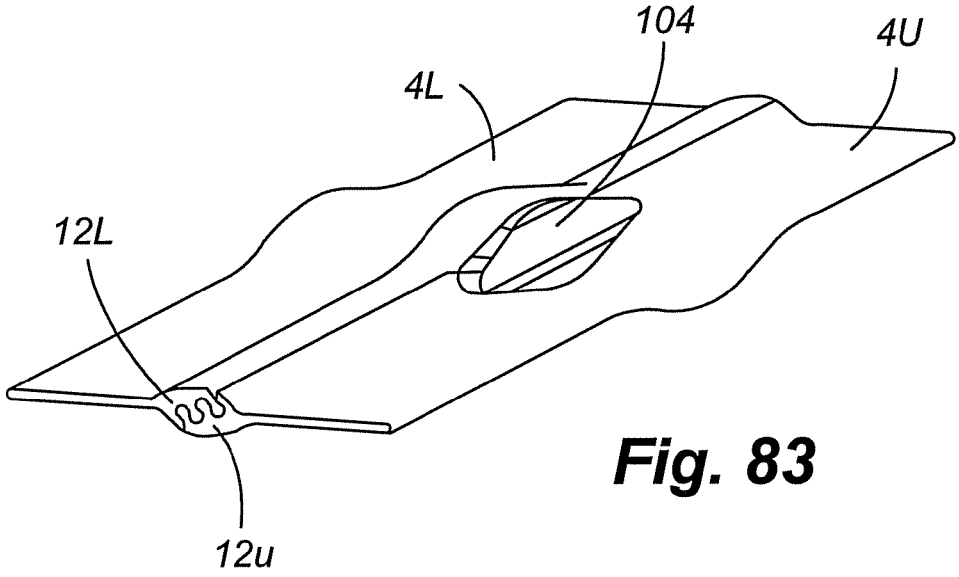
FIG. 83 is a bottom perspective view of the sealing device shown in FIG. 70 interconnecting two fastening members.
Figure 84:
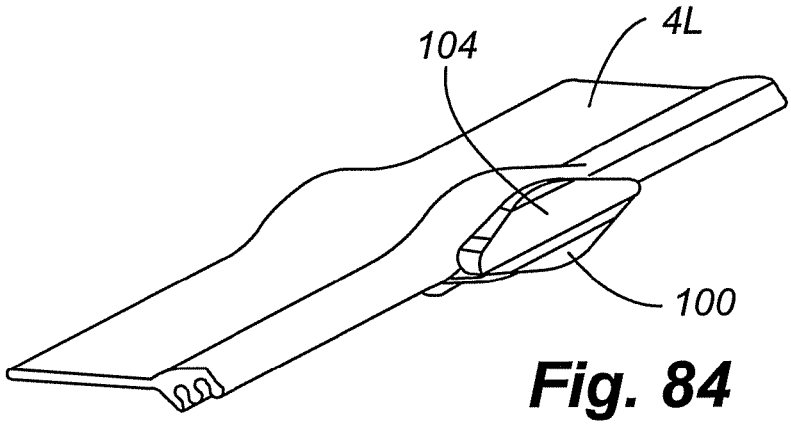
FIG. 84 is a bottom perspective view similar to that of FIG. 83 wherein the upper fastening member has been removed for clarity.
Figure 85:
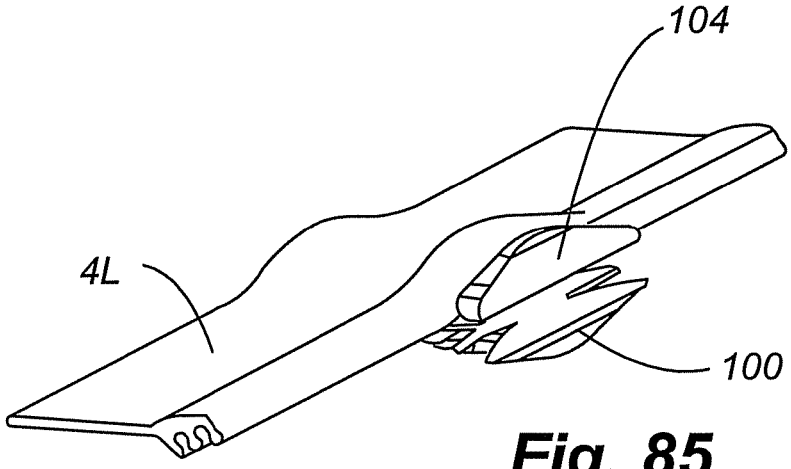
FIG. 85 is a bottom perspective view similar to that shown in FIG. 84 wherein the intermediate member is shown in an open position.
Figure 86:
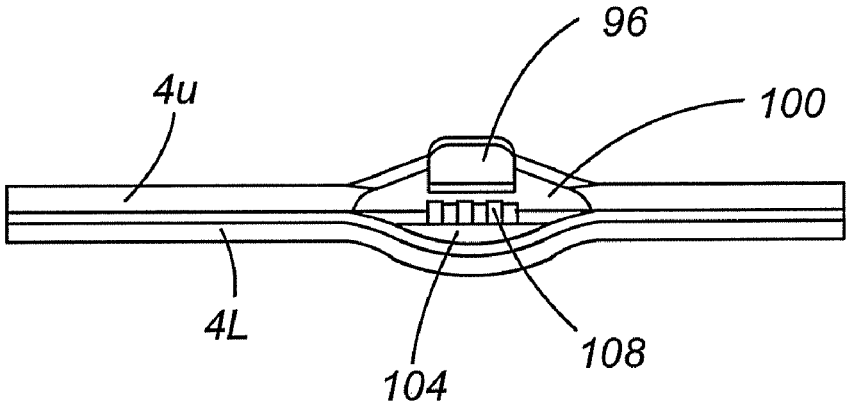
FIG. 86 is a right elevation view of FIG. 77.
Figure 87:
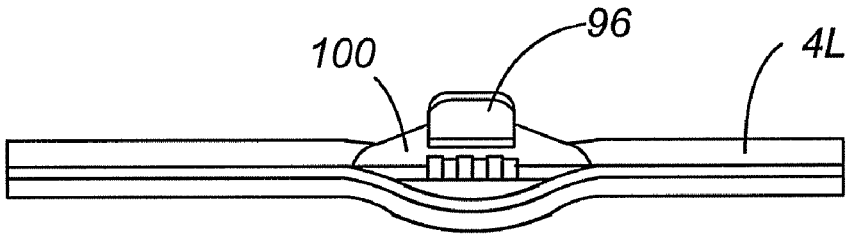
FIG. 87 is a right elevation view similar to that of FIG. 86 wherein the upper fastening member has been removed for clarity.
Figure 88:
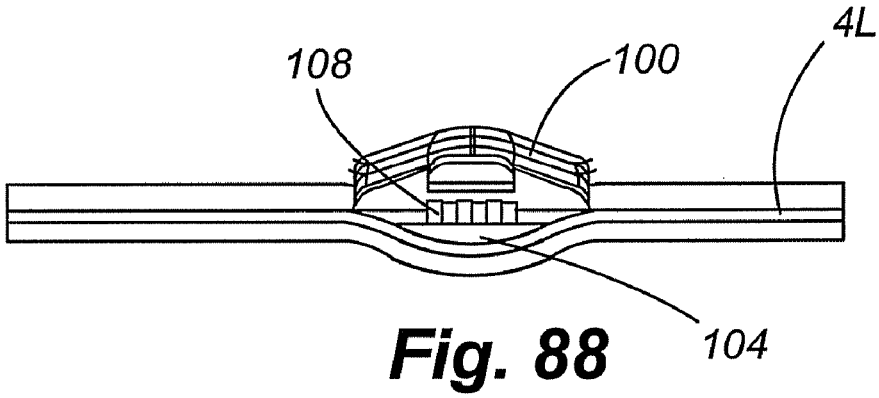
FIG. 88 is a right elevation view similar to that of FIG. 87 wherein the intermediate member is shown in an open position.
Figure 89:
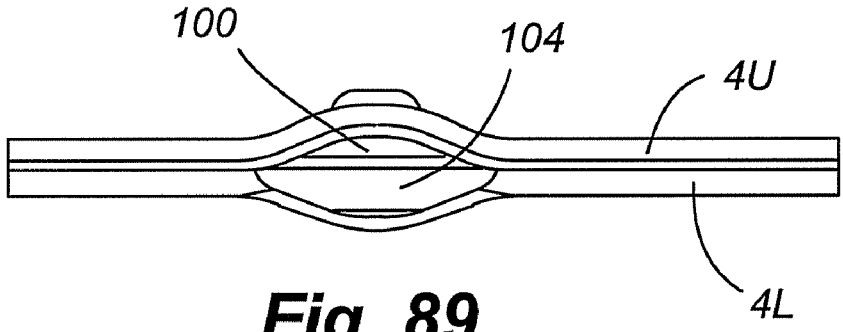
FIG. 89 is a left elevation view of FIG. 77.
Figure 90:
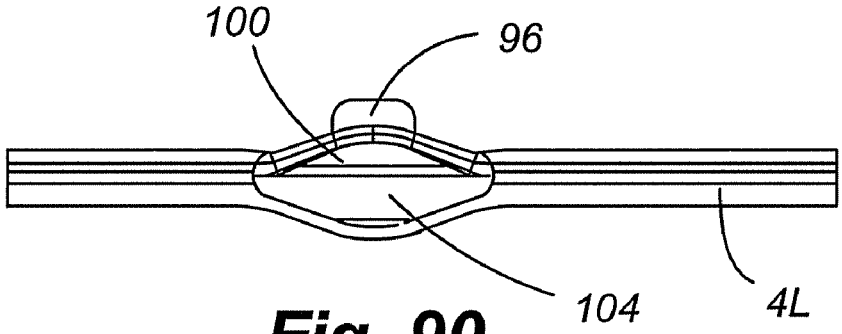
FIG. 90 is a left elevation view similar to that of FIG. 89 wherein the upper fastening member has been removed for clarity.
Figure 91:
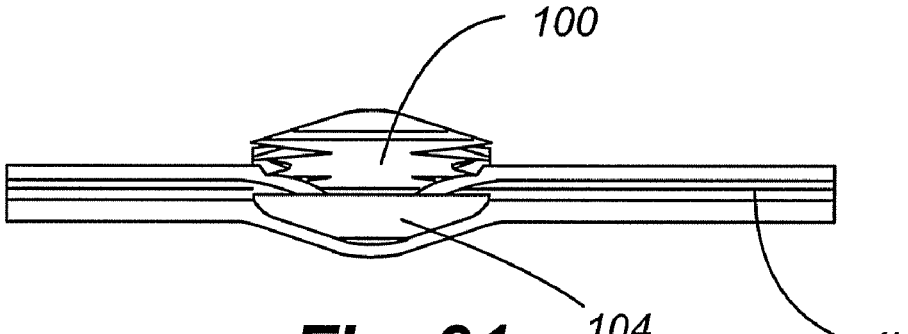
FIG. 91 is a left elevation view similar to that of FIG. 90 when the intermediate member is shown in an open position.
Figure 92:
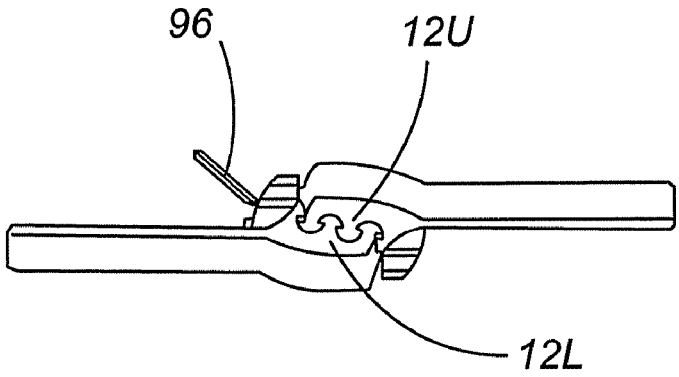
FIG. 92 is a front elevation view of FIG. 77.
Figure 93:
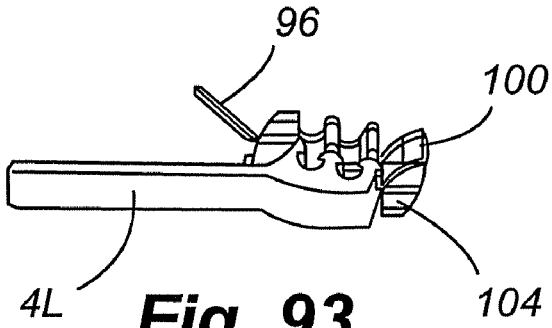
FIG. 93 is a front elevation view similar to that of FIG. 92 wherein the upper fastening member has been removed for clarity.
Figure 94:
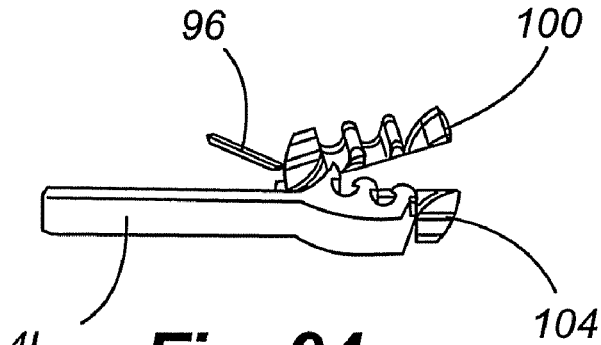
FIG. 94 is a front elevation view similar to that of FIG. 93 wherein the intermediate member is shown in an open position.
Figure 95:
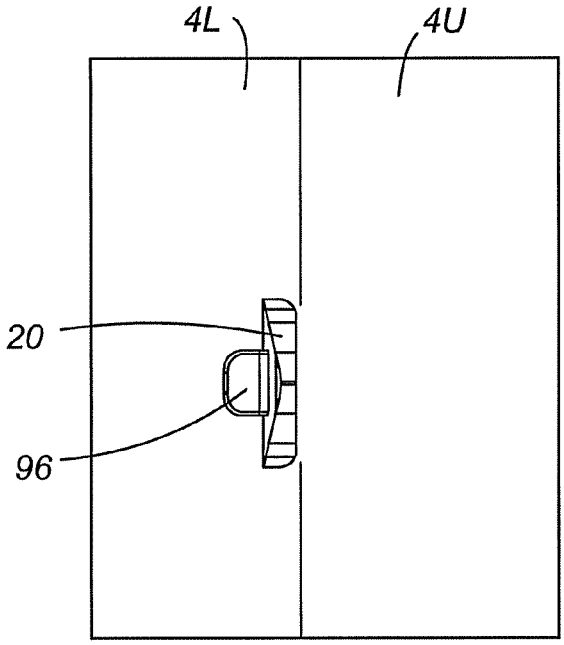
FIG. 95 is a top elevation view of FIG. 77.
Figure 96:
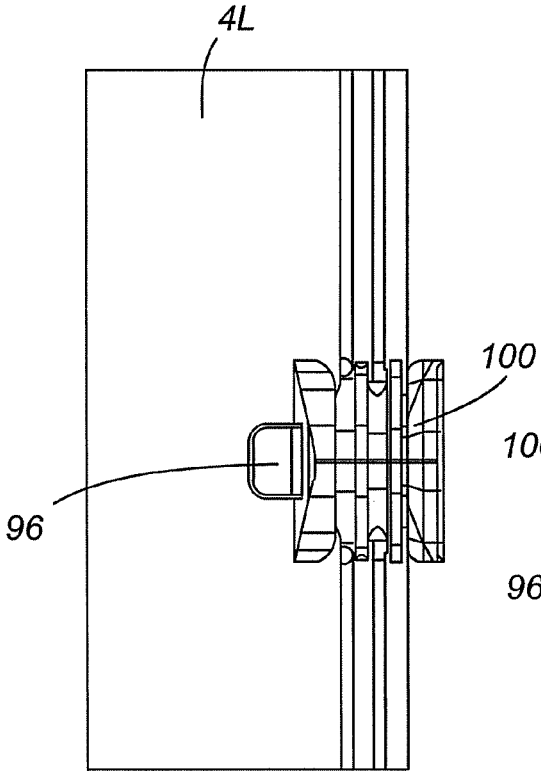
FIG. 96 is a top elevation view similar to that of FIG. 95 wherein the upper fastening member has been removed for clarity.
Figure 97:
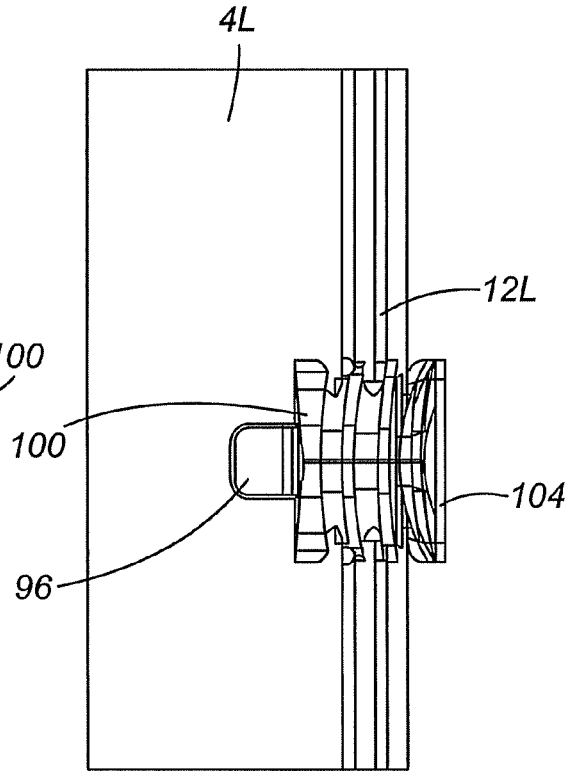
FIG. 97 is a top elevation view similar to that of FIG. 96 wherein the intermediate member is shown in an open position.

Referring now to FIGS. 39-48, operation of this embodiment of the present invention is shown. Here, the stationary control arm 52 is shown positioned adjacent to the upper fastening member 4U, thereby maintaining a force on the upper rail fastener 12U and the lower rail fastener 12L. Referring specifically to FIG. 43, as the sealing device 2 is moved to the left, the intermediate member 20 will separate the upper rail fastener 12U and the lower rail fastener 12L. By moving the sealing device 2 back to the right, the stationary control arms 52 will reinterconnect the upper rail fastener 12U and the lower rail fastener 12L. Rotation of the intermediate member 20 will allow for a larger gap to be formed between the upper rail fastener 12U and the lower rail fastener 12L and allow for cleaning of the intermediate member 20 and the rails of the respective rail fasteners 12.

Referring now to FIGS. 49-69, yet another embodiment of an intermediate member 20 is provided that includes a movable segment 92 interconnected to a tab 96. As described above, when the intermediate member 20 is positioned between the lower fastening member 4L and an upper fastening member 4U, the gap between the two fastening members is plugged. By transitioning the movable segment 92 of the intermediate member 20 with the tab 96, the rail fasteners 12 are separated, thereby providing a larger gap and the impetus of creating the separation between the two rail fasteners 12. In operation, the tab 92 is transitioned upwardly (or alternatively rotated) to split the rail fasteners 12. While maintaining the movable segment 92 in its second, opened position, the tab 96 is used to assist in moveably transitioning the intermediate member along the rail fasteners 12 to complete the separation of the upper fastening member 4U and the lower fastening member 4L. The upper fastening member 4U and the lower fastening member 4L may be resealed either manually by moving one's hand along the rail fasteners, or with the aid of the control arms (not shown) described above.

Referring now to FIGS. 70-97, yet another embodiment of the intermediate member 20 of the present invention is provided that is somewhat similar to that shown in FIGS. 49-69. More specifically, in this embodiment of the present invention, the intermediate member 20 employs a clam shell configuration wherein a top half 100 is rotatably interconnected to a bottom half 104 via a longitudinal hinge 108. An angled tab 96 is also provided wherein pressure on the angled tab forces the clam shell shaped intermediate member 20 to widen, thereby separating the upper rail fastener 12U and the lower rail fastener 12L. In operation, in order to facilitate separation of the upper fastening member 4U and the lower fastening member 4L, the tab 96 is pressed wherein the hingedly interconnected top half 100 separates from the bottom half 104 which causes the rails fore and aft of the intermediate member 20 to disengage and form a gap between the upper fastening member 4U and the lower fastening member 4L. By then moving the intermediate member 20 in its open configuration along the edge of the rail fasteners 12, the fastening members 4 are opened. The fastening members may be resealed either manually by moving one's hand along the rail fasteners, or with the aid of the control arms (not shown) described above.

Figure 98:
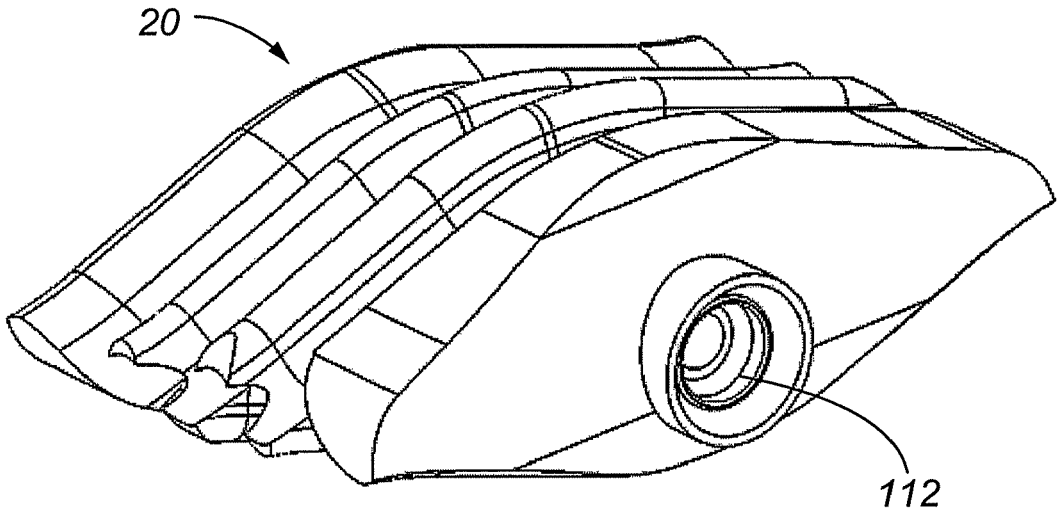
FIG. 98 is an intermediate member of another embodiment of the present invention that includes a valve.

Referring now to FIG. 98, an intermediate member 20 of another embodiment of the present invention is provided that includes a valve 112. More specifically, one skilled in the art will appreciate that although the intermediate member 20 generally employs the gap between the upper fastening member and the lower fastening member, selective access to the sealed environment may be desirable. Thus one embodiment of the present invention provides a valve 112 integrated into the intermediate member 20 that relieves pressure when the contents within a bag are heated, for example. Further one skilled in the art will appreciate the valve 112 as contemplated herein may be also used to maintain a vacuum within the sealed environment. Various types of valves such as one-way check valves, pressure relief valves, etc. are contemplated by the intermediate member 20 of this embodiment of the invention.

Figure 99:
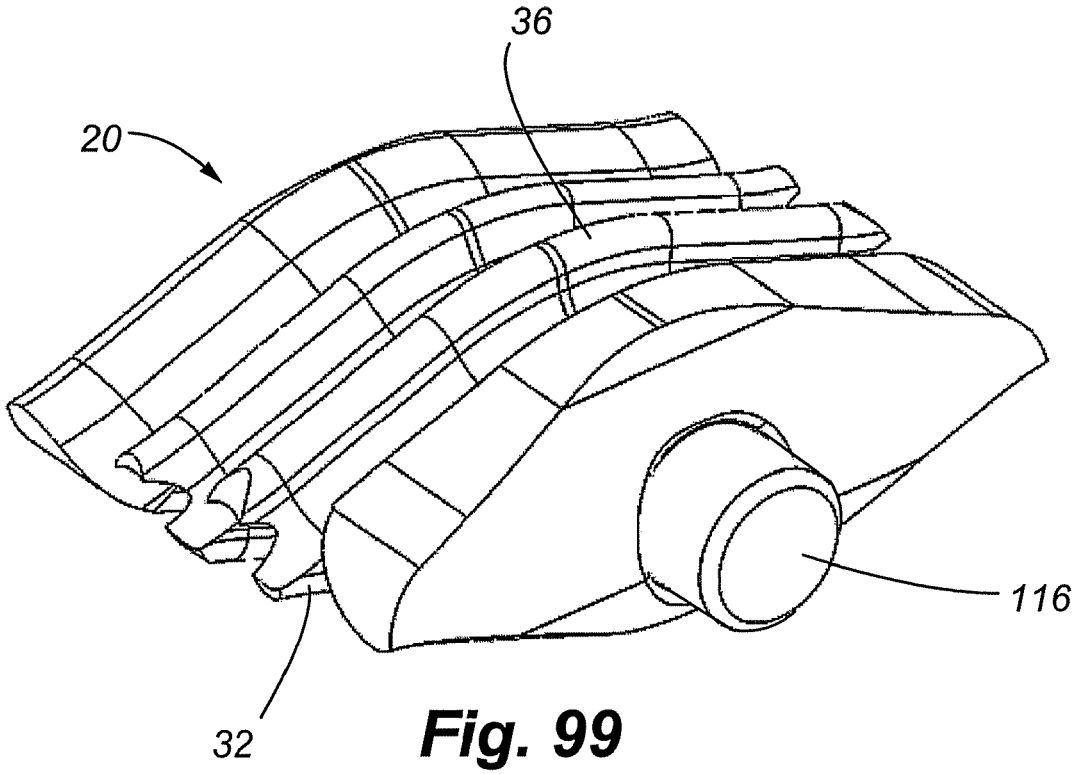
FIG. 99 is an alternate embodiment of an intermediate member having a deformable contour.

Referring now to FIG. 99, another embodiment of the intermediate member 20 of the present invention is shown that includes a button 116 that is used to selectively alter the shape of the intermediate member 20. Here, the intermediate member 20 is at least partially constructed of a deformable material such that when the button 116 is transitioned within the intermediate member 20, it expands. As used herein "deformable" may also refer to any alteration in shape of the intermediate member 20 by stress exerted upon the material of the intermediate member during closing or opening of a closure arm, for example via a cam. Expansion of the intermediate member 20 causes the upper contour 36 and/or the lower contour 32 to more tightly engage the interstitial spaces between the rails of the upper rail fastener and/or the lower rail fastener, thereby enhancing the seal between the two rail fasteners. By way of example and not limitation, expansion of the intermediate member 20 may also be achieved by a pump, adjustable bladder, etc.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

What is claimed is:

1. A fastening system, comprising:

a first fastening member including a first mating surface;

a second fastening member including a second mating surface, wherein said second mating surface is adapted for positioning substantially opposite said first mating surface for operatively engaging said first mating surface;

an intermediate member having an upper contour and a lower contour that defines a thickness between said upper contour and said lower contour, said thickness having a mid point, said intermediate member also having a first leader end and a second leader end, and wherein a distance between said upper contour and said lower contour is greatest at about the mid point; and a plurality of arms interconnected to said intermediate member, at least one of said plurality of arms including an inner surface for engaging against an exterior surface of one of said first mating surface and said second mating surface, wherein at least two of said plurality of arms confine said first mating surface and said second mating surface in an interlocking and sealed fashion.

2. The fastening system of claim 1 wherein said upper contour and said lower contour of said intermediate member forms a seal with said first mating surface or said second mating surface.

3. The fastening system of claim 1, wherein at least one of said plurality of arms is rotatably interconnected to said intermediate member.

4. The fastening system of claim 3, wherein the at least one of said plurality of arms is rotatably interconnected to said intermediate member via a hinge.

5. The fastening system of claim 1, wherein said intermediate member includes at least one portion that is movable.

6. The fastening system of claim 1, wherein said plurality of arms comprise two stationary arms and wherein said intermediate member is rotatable with respect to said two stationary arms.

7. The fastening system of claim 1, wherein said intermediate member comprises a valve for controlling a flow of at least one of a liquid and gas through said intermediate member.

8. The fastening system of claim 1, wherein said intermediate member includes a top half and a bottom half that are interconnected via a hinge.

9. The fastening system of claim 1, wherein said intermediate member at least partially separates along a plane that is defined by said first leader end, said mid-point and said second leader end.

10. The fastening system of claim 1, wherein the intermediate member is not deformable.

11. The fastening system of claim 1, wherein the intermediate member has at least one surface which is deformable.

12. The fastening system of claim 1, wherein the intermediate member is constructed of a material which is different that at least one of the plurality of closure arms.

13. The fastening system of claim 1, wherein the intermediate member is constructed of at least two different materials.

14. The fastening system of claim 1, wherein at least one of the plurality of closure arms is not deformable.

15. The fastening system of claim 1, wherein at least one of the plurality of closure arms has at least one surface which is deformable.

16. An article employing the fastening system of claim 1.

17. A fastening system, comprising:

a first fastening member including a first mating surface;

a second fastening member including a second mating surface, wherein said second mating surface is adapted for being positioned generally opposite said first mating surface for operatively engaging said first mating surface;

an intermediate member having a profile which forms and maintains a continuous seal with said first mating surface and said second mating surface; and a plurality of arms interconnected to said intermediate member.

18. The fastening system of claim 17, wherein said intermediate member is separable.

19. The fastening system of claim 17, wherein said intermediate member is nonseparable.

20. The fastening system of claim 17, wherein one or more of said plurality of arms are capable of a locking relationship with respect to said intermediate member.

21. The fastening system of claim 20, wherein said arms lock into at least one of an opening position and a closing position.

22. A sealing device comprising:

an intermediate member having an upper contour and a lower contour that defines a thickness between said upper contour and said lower contour, said thickness having a mid point, said intermediate member also having a first leader end and a second leader end, and wherein a distance between said upper contour and said lower contour is greatest at about the mid point; and a plurality of arms interconnected to said intermediate member.

23. The sealing device of claim 22, wherein said upper contour and said lower contour of said intermediate member comprises a undulating surface having a plurality of grooves.

24. The sealing device of claim 22, wherein at least one of said plurality of arms is rotatably interconnected to said intermediate member.

25. The sealing device of claim 22, wherein said intermediate member includes at least one portion that is movable.

26. The sealing device of claim 22, wherein said plurality of arms comprise two stationary arms and wherein said intermediate member is rotatable with respect to said two stationary arms.

27. The sealing device of claim 22, wherein said intermediate member comprises a valve for controlling a flow of at least one of a liquid and gas through said intermediate member.

28. The sealing device of claim 22, wherein said intermediate member includes a top half and a bottom half that are interconnected via a hinge.

29. The sealing device of claim 22, wherein said intermediate member at least partially separates along a plane that is defined by said first leader end, said mid-point and said second leader end.

30. The sealing device of claim 22, wherein at least one of said upper contour and said lower contour is deformable.

31. The sealing device of claim 22, wherein said intermediate member is constructed of a material which is different that at least one of said plurality of arms.

32. The sealing device of claim 22, wherein said intermediate member is constructed of at least two different materials.

33. The sealing device of claim 22, wherein at least one of said plurality of arms has at least one surface which is deformable.

34. A fastening system, comprising:

a first fastening member including a first mating surface;

a second fastening member including a second mating surface, wherein said second mating surface is adapted for operative engagement with said first mating surface;

a first slider having a opening end orifice and a closing end orifice;

a second slider having a opening end orifice and a closing end orifice and oriented such that the opening end orifice of the first slider is juxtaposed to the opening end orifice of the second slider to form a separable intermediate member whereby the separable intermediate member maintains a seal with the mating surfaces of said closure members; and at least one closure arm interconnected to each of the first and second sliders, the closure arms including an inner surface for pressing against an exterior surface of one of the first and second mating surfaces, wherein at least two of the closure arms confine the first and second mating surfaces in an interlocking and sealed configuration.

* * * * *